US005536203A

United States Patent [19]

Takeyoshi et al.

[11] Patent Number: 5,536,203

[45] Date of Patent: Jul. 16, 1996

[54] VIBRATORY DRUM MACHINE FOR TREATING ARTICLES

[75] Inventors: Nonaka Takeyoshi; Hashimoto Keiji, both of Toyohashi; Maze Masayuki; Horiuchi Teruo, both of Kosai; Sonobe Kazuki; Ikeda Masahiro, both of Toyohashi, all of Japan

[73] Assignee: Shinko Electric Co., Ltd., Tokyo, Japan

[21] Appl. No.: 330,252

[22] Filed: Oct. 27, 1994

Related U.S. Application Data

[63] Continuation of Ser. No. 803,094, Dec. 5, 1991, abandoned.

[30] Foreign Application Priority Data

| | | | |
|---|---|---|---|
| Dec. 7, 1990 | [JP] | Japan | 2-407416 |
| Apr. 30, 1991 | [JP] | Japan | 3-126576 |
| Jun. 19, 1991 | [JP] | Japan | 3-174606 |
| Jul. 11, 1991 | [JP] | Japan | 3-196977 |
| Sep. 10, 1991 | [JP] | Japan | 3-258573 |

[51] Int. Cl.[6] ..... B24B 31/00

[52] U.S. Cl. ..... 451/326; 451/328; 241/283; 241/DIG. 10

[58] Field of Search ..... 451/32, 326, 328; 241/175, 273.3, 283, 284, DIG. 10; 209/284, 473, 504

[56] References Cited

U.S. PATENT DOCUMENTS

| | | | |
|---|---|---|---|
| 3,624,970 | 12/1971 | Balz | 451/326 |
| 3,991,524 | 11/1976 | Ferrara | 451/326 |
| 4,527,747 | 7/1985 | Scharmer et al. | 241/283 X |
| 4,926,601 | 5/1990 | Musschoot | 451/328 X |
| 5,109,633 | 5/1992 | Durnil | 451/326 |

FOREIGN PATENT DOCUMENTS

| | | | |
|---|---|---|---|
| 3115806 | 11/1982 | Germany | 451/326 |

*Primary Examiner*—William E. Terrell
*Assistant Examiner*—Tuan Nguyen
*Attorney, Agent, or Firm*—Rockey, Rifkin & Ryther

[57] ABSTRACT

A vibratory drum machine for treating articles includes a cylindrical drum body supported resiliently by springs; and a circular or elliptic vibratory force generating mechanism fixed on the peripheral wall of the cylindrical drum body above the horizontal line passing perpendicularly through the central axis of the cylindrical drum.

16 Claims, 30 Drawing Sheets

VIBRATORY DRUM MACHINE FOR TREATING ARTICLES

This is a continuation of application Ser. No. 07/803,094, filed Dec. 5, 1991, now abandoned.

BACKGROUND OF THE INVENTION

1. Field of the Invention

This invention relates to a vibratory drum machine used especially for cleaning and cooling cast components to which the molding sand still adheres.

2. Description of the Prior Art

In FIG. 1, the vibratory drum machine of the prior art for cleaning and cooling the cast components is shown in general at 10. A support member 15 is fixed through strengthening ribs 26 to a cylindrical drum body 11. A mounting frame 12 is supported through springs 14 by the support member 15.

An inlet 25, into which the cast components to be cooled and cleaned are supplied, is formed at the left end portion of the cylindrical drum body 11 (FIG. 1). A discharge chute 24 is connected to the right end of the cylindrical drum body 11. The cooled and cleaned cast components are discharged outwards through the discharge chute 24. The left end of the drum body 11 is covered with an end wall 22*a* and the right end thereof is partially covered with an end wall 22*b*.

The drum body 11 is resiliently supported on the earth E by coil springs 16*a*, 16*b*, 17*a* and 17*b*. A drive source 13 consisting of a pair of vibratory electric motors 19*a* and 19*b* is fixed on the mounting frame 12. The vibratory electric motors 19*a* and 19*b* have well-known constructions. Nearly semi-circular unbalance weights 20*a* and 20*b* are fixed to rotary shafts 21*a* and 21*b* of the vibratory electric motors 19*a* and 19*b*. A reinforcing partition 23 is fixed to the center of the mounting frame 12. The vibratory electric motors 19*a* and 19*b* are fixed in symmetry on the mounting frame 12 with respect to the reinforcing partition 23. The unbalance weights 20*a* and 20*b* are rotated in the opposite directions, and they are fixed to the rotary shafts 21*a* and 21*b* in the same rotary phase. A dust collecting duct 18 is fixed on the upper wall portion of the drum body 11 and it communicates with an internal space 27 of the drum body 11. As described below, a dust generating in the cleaning and cooling operation of the cast components M is guided outwards through the dust collecting duct 18. The entire vibratory drum machine 10 is so arranged as to be inclined towards the discharge chute 24 by a few degrees.

When the drive source 13 is excited, the vibratory electric motors 19*a* and 19*b* are rotated in synchronization with each other. The pair of the vibratory electric motors 19*a* and 19*b* are driven at a frequency which is near to a resonance frequency. The resonance frequency is predetermined by a spring constant of the coil springs 14, and the masses of the entire drum body 11 and drive source 13. A linear vibratory force is generated in the direction along the coil springs 14. The vibratory force is transmitted to the drum body 11 through the coil springs 14 and support member 15. Since the drum body 11 is resiliently supported by the coil springs 16*a*, 16*b*, 17*a* and 17*b*, the drum body 11 is vibrated in an oblique direction as shown by a arrow A. Accordingly, the cast components M and sand S circulate as shown by the arrows in the internal space 27 of the drum body 11. The drum body 11 is inclined towards the discharge chute 24 by a few degrees. Accordingly, the cast components M and sand S are moved to the discharge chute 24 together with the circulation as shown by arrows in FIG. 2. In such a motion, the cast components M and sand S are separated from each other and they are discharged outwards through the discharge chute 24.

The vibratory drum machine 10 of the one prior art is so constructed as above described and operates in the above manner.

In a sand-separating machine of another prior art, a plate having plural slits is arranged and cast components to be cleaned and cooled are supplied onto the plate. It is vibrated in a linear direction. The sand separated from the cast components is discharged downwards through the plural slits and the cast components are moved on the plate by the linear vibratory motion. However, in this type sand-separating machine for the cast components, the cast components often are damaged by the shock. Further, some cast components freely can not move on the plate. Thus, some cast components are not be cleaned and cooled so much sufficiently according to their shape and the sands are not fallen from the cast components. On the other hand, the vibratory drum machine 10 of the above one prior art can remove the above described defects of the sand-separating machine.

Further, the pair of the vibratory electric motors 19*a* and 19*b* does not always synchronize with each other. When they are not synchronized with each other, some irregular vibratory force is imparted to the drum body 11. In that case, the above described operations are not effected and so the sands are not freely separated from the cast components. Further, the vibratory drum machine 10 of the one prior art has the same defect as the sand-separating machine as above described. For example, the cast components M sometimes are damaged on the internal wall of the drum body 11. To cope with this defect, the mounting position of the vibratory electric motors 19*a* and 19*b* to the drum body 11 and the arrangements of the coil springs 14 should be strictly designed so that the vibratory electric motors 19*a* and 19*b* can be rotated in synchronization with each other. Accordingly, the vibratory drum machine 10 of the one prior art as shown in FIG. 1 and FIG. 2 is much expensive and further the resonant condition can not be often obtained according to the sum weight of the supplied cast components M and sand S and their mass distribution. Accordingly, the synchronization of the rotation can not be often obtained.

In a sand-separating machine of a further type, a drum is rotated at a predetermined speed in a predetermined direction. It is so called "rotary drum". The cast components are brought up by engagement with members fixed on the internal wall of the drum and they are dropped out at some height. Accordingly, the cast components are often damaged on shock to the inside wall of the drum. Further, since contact time of the cast components with inside wall of the drum is long, the sand is often aged and also adding agent is often aged. Further, when the cast components are fallen onto the bottom portion of the drum, periodical noises are made. The vibratory drum machine of the one prior art is superior to this type sand-separating machine in the above defects. However, there are some points to be resolved as above described.

FIG. 3 and FIG. 4 show a vibratory drum machine of another type. Parts in FIG. 3 which correspond to those in FIG. 1 and FIG. 2, are denoted by the same reference numerals, the detailed description of which will be omitted. In this example, a vibratory force generating mechanism 13' for generating a linear vibratory force is mounted on the peripheral wall of the drum body 11. It consists of a pair of vibratory electric motors 22A and 22B. They are fixed on a mounting member 35. Gears 29*a* and 29*b* of the same diameter and the number of teeth are fixed on one end portion of the shafts 23*a* and 23*b* of the electric motors 22A and 22B. Gears 30*a* and 30*b* of smaller diameter are engaged with the gears 29*a* and 29*b*. The axes of the gears 30*a* and 30*b* are supported on a bearing housing 28. Electric power source cords 31 to an alternating power source are connected to the vibratory electric motors 22A and 22B. The electric motors 22A and 22B are driven in the opposite directions.

Substantially semi-circular unbalance weights 24*a* and 24*b* fixed to one end portions of the rotary shafts 23*a* and 23*b* are rotated at the same speed in synchronization with each other, and in the opposite directions through the engagements of the gears 30*a*, 30*b* and 29*a*, 29*b*. Thus a linear vibratory force is generated in a X direction as shown in FIG. 3.

Although, the vibratory drum machine 10' of the other type is constructed simply as above described and it has the following defects.

The drum body 11 of this type is in the shape of cylinder, too. And the cast components to be cooled and cleaned are moved along the central axis C of the drum body 11. It is supported resiliently by the coil springs 17*a* and 17*b*. Further, the vibratory exciter mechanism 13' consisting of the two vibratory electric motors 22A and 22B is fixed onto the peripheral wall of the drum body 11. Further also in this type, the substantially semi-circular unbalance weights 24*a* and 24*b* are fixed to the driving shafts 23*a* and 23*b* of the vibratory electric motors 22A and 22B. The gears of the same diameter and the same number of teeth are fixed to the one end portion of the driving shafts 23*a* and 23*b* and they are engaged with each other. Accordingly, the two vibratory electric motors 22A and 22B are rotated at the same speed in the opposite directions and in synchronization with each other. Thus, a linear vibratory force is generated in a direction P as shown by a arrow in FIG. 5. It intersects with the axis C of the drum body 11 at a right angle. When no cast components are supplied into the drum body 11, or when no load is applied to the drum body 11, different points on the peripheral wall of the drum body 11 are linearly moved as shown by the arrows in FIG. 5. The direction of the movement of the points on the peripheral wall are substantially parallel with the linear vibratory force direction P.

It makes an angle α relative to the horizontal line H—H at the peripheral position at which the vibratory force generating mechanism 13' is mounted on the peripheral wall of the drum body 11. Thus, the points on the peripheral wall of the drum body 11 are vibrated almost at the same amplitude and same vibratory angle.

When some cast components M to be cleaned and cooled are supplied into the drum body 11, the cast components M and sand S circulate as shown by the arrow in the same manner as above described prior art. However, the amplitudes of the points on the peripheral wall are greatly decreased in comparison with those in the no-load condition. Accordingly, actually the circulating motion as shown is difficult to be obtained, and further the circulating speed is decreased since the amplitude is smaller. Further, the fluidity is deteriorated in comparison with the above described prior art.

The reason for the above defect will be described. The cast components M to be cleaned and cooled are driven together with the drum body 11 in the vibratory direction P which is obtained under the no-load condition. The vibratory direction of the point on the bottom of the drum body 11 is substantially equal to the direction P as shown by the arrow $a_1'$. However at the angle portion $a_2'$ of 45 degrees in the counterclockwise direction, the vibratory directions of the points are substantially parallel to the direction P under the no-load condition. Accordingly, the direction of the vibration of the point at the angle 45° is substantially parallel to the internal wall surface of the drum body 11 as shown by the arrow $a_2'$. Accordingly, it is clear from the theory of the vibration that the acceleration of the point in the vertical direction to the surface of the inside wall of the drum body 11 is smaller than 1 G. Accordingly, the cast components and sands can not jump from the wall surface of the drum body 11. The forward movement due to the vibration can not be imparted to the cast component and sands. Further, at a point of a larger angle, it is preferable to move the cast components and sands relative to the inside surface of the drum body 11 in the counterclockwise direction. However, actually the cast components and sands are moved in the clockwise direction. Accordingly, the movement of the cast components and sands at the larger angle position $a_3'$ is opposed to the movement of the cast components and sands at the lowest point $a_1'$. Thus, the cast components M and sands S separated from the cast components M push the inside wall surface of the drum body 11. As if the cast component M and sands S is integrated with the drum body 11 as a rigid body, they are vibrated as one body. Accordingly, it is natural that the amplitude of the different points on the peripheral wall of the drum body 11 are decreased and the fluidity is deteriorated as above described.

Further, in this prior art, the vibratory drum machine is driven, for example, at the power frequency of 60 Hz and vibrated at the rotational speed of 894 r.p.m. In the technical field of the vibration, the frequency of 894 r.p.m. belongs to the super low frequency zone. Accordingly, the houses which are adjacent to or near the vibratory drum machine are almost under a resonant condition of the super low frequency vibration. Thus, the houses and further the doors and desks are vibrated. A public nuisance is imparted to the people which live near the factory in which the above described vibratory drum machine is arranged.

Further, the gears are fixed to the driving shaft in the above described prior art. They are engaged with each other and they are rotated in the opposite directions. Even when the engagement with the gears is accurately designed, the engagement sound can not be zero. Further, the noise is in a high frequency zone. Such a noise is of a public noise nuisance to the people which live near the factory in which the vibratory drum machine is arranged.

SUMMARY OF THE INVENTION

Accordingly, it is an object of this invention to provide a vibratory drum machine in which amplitude decrease of different points can be small in contrast with the prior art, when some load is applied, and so fluidity of cast components and sands can be improved.

Another object of this invention to provide a vibratory drum machine which can prevent public nuisance of the super low frequency to the houses near the factory.

In accordance with an aspect of this invention a vibratory drum machine for treating articles comprising: (A) a cylindrical drum body supported resiliently by springs; and (B) a circular or elliptic vibratory force generating source fixed on the peripheral wall of said cylindrical drum body above the horizontal line passing perpendicularly through the central axis of said cylindrical drum body.

The foregoing and other objects, features, and advantages of the present invention will be more readily understood upon consideration of the following detailed description of the preferred embodiments of the invention, taken in conjunction with the accompanying drawings.

DESCRIPTION OF THE PREFERRED EMBODIMENTS

Figure 1:
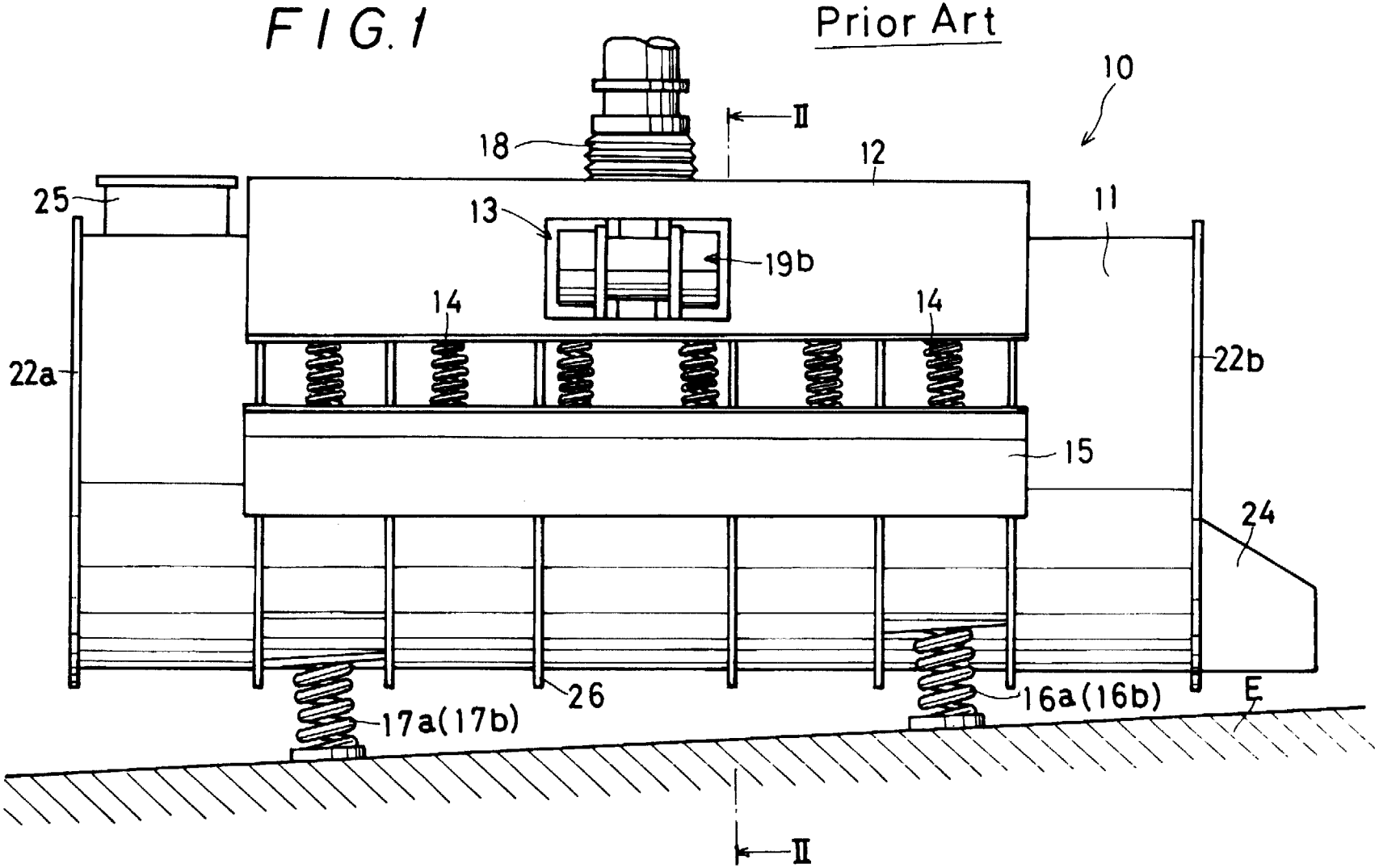
Prior Art FIG. 1
FIG. 1 is a side view of a vibratory drum machine of a prior art.
Figure 2:
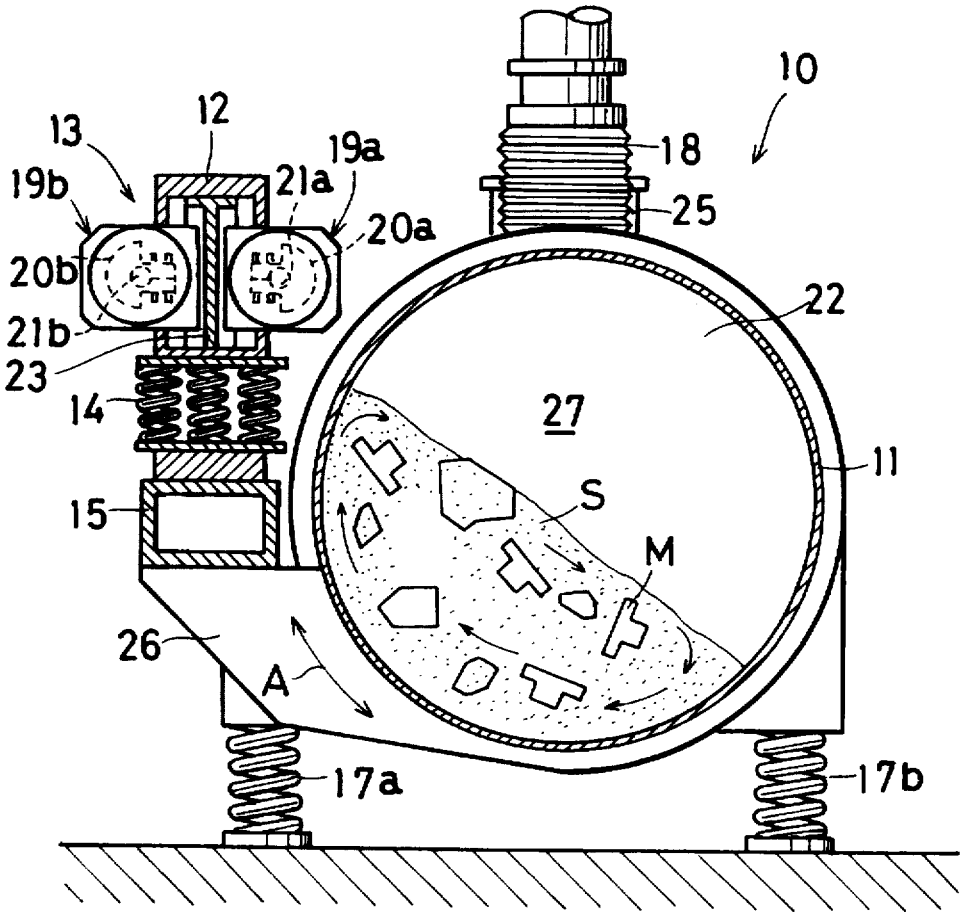
FIG. 2 Prior Art
FIG. 2 cross-sectional is a view taken along the line II—II of FIG. 1.
Figure 3:
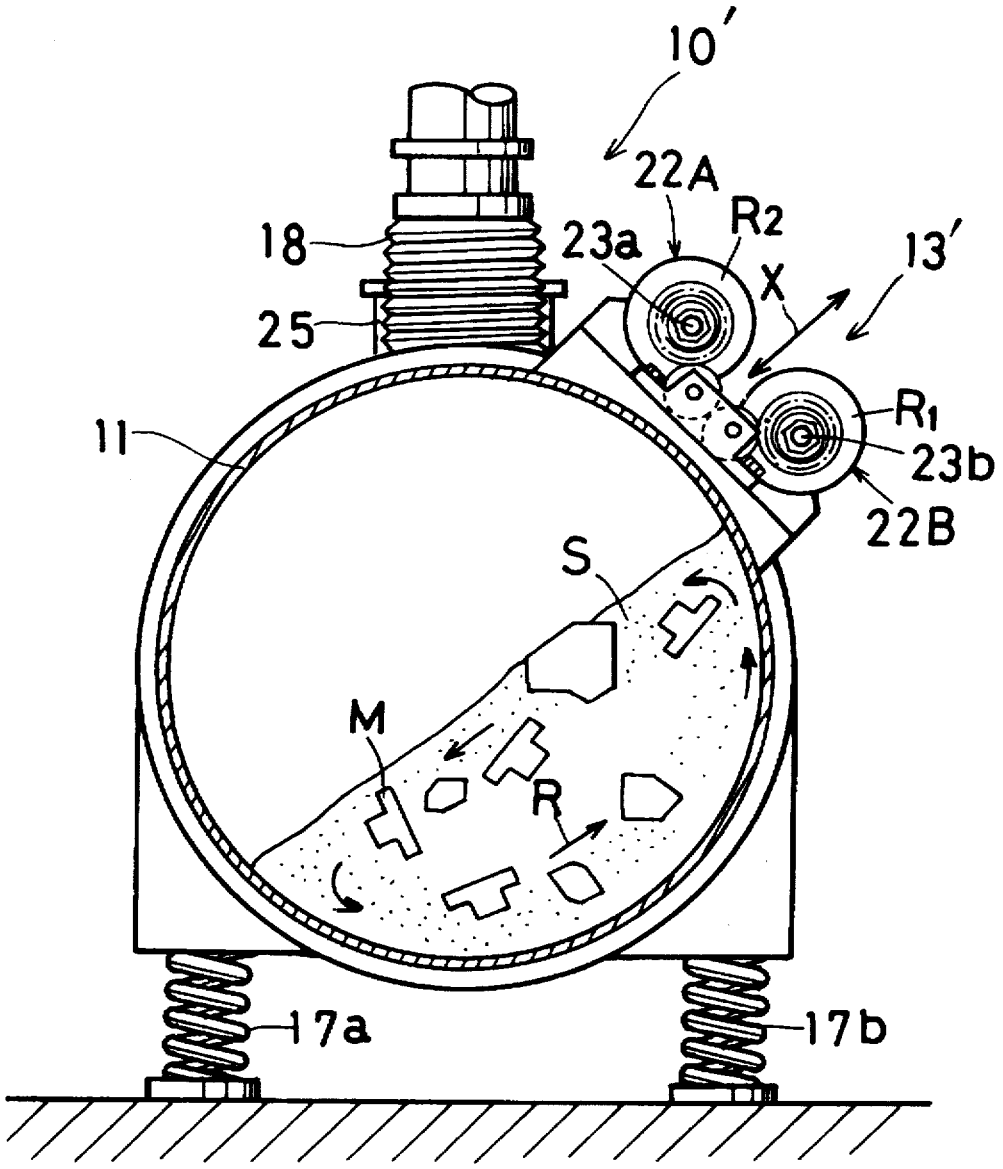
FIG. 3 Prior Art
FIG. 3 cross-sectional is a view of a vibratory drum machine of another prior art, similar to FIG. 2.
Figure 4:
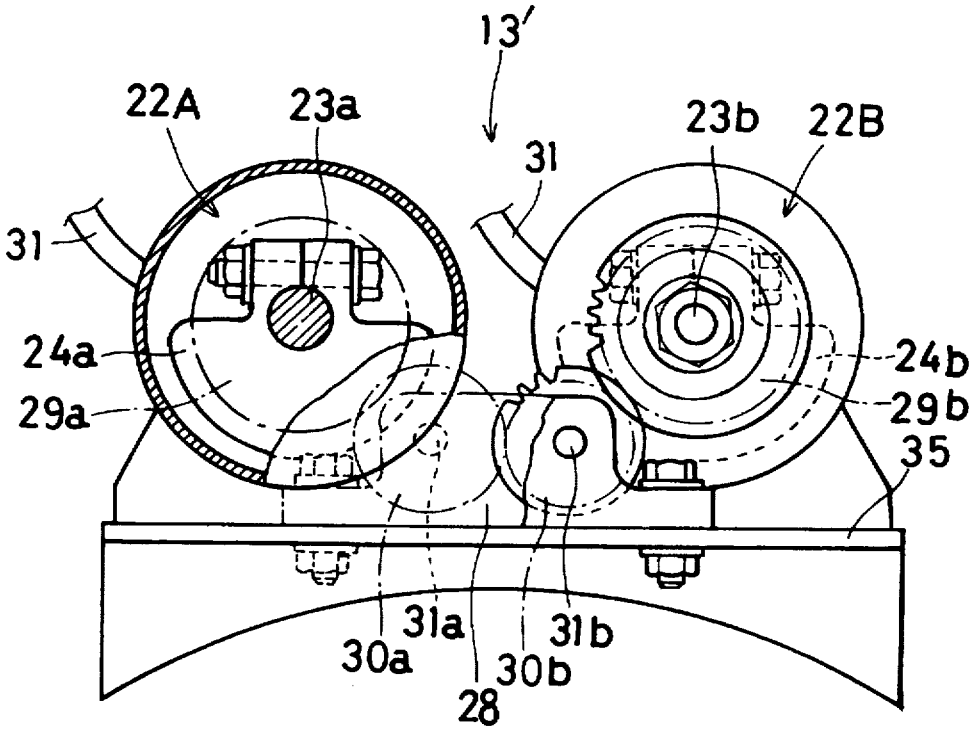
FIG.4 Prior Art
FIG. 4 is an enlarged front view of a vibratory exciter in FIG. 3.

FIG. 6 to FIG. 10 show a vibratory drum machine according to a first embodiment of this invention. In FIG. 1, a vibratory drum machine is designated generally by a reference numeral 41A. A vibratory exciter 43 according to this invention is arranged at one side of the peripheral wall of a cylindrical drum body 42. The drum body 42 is resiliently supported by supporting members 44*a*, 44*b*, 45*a* and 45*b* through coil springs 46*a*, 46*b*, 47*a* and 47*b* so that it is inclined downwards at an angle of a few degrees. An inlet 48, through which cast components to be cooled and cleaned are supplied, is formed at the left end portion (FIG. 6) of the drum body 42 and an outlet 49, through which the cleaned and cooled cast components are discharged, is formed at the right end portion of the drum body 42.

Reinforcement ribs 50 are fixed to the peripheral wall of the drum body 42 to strengthen the drum body 42. A right end open of the drum body 42 is covered partially with a cover member 51.

Figure 7:
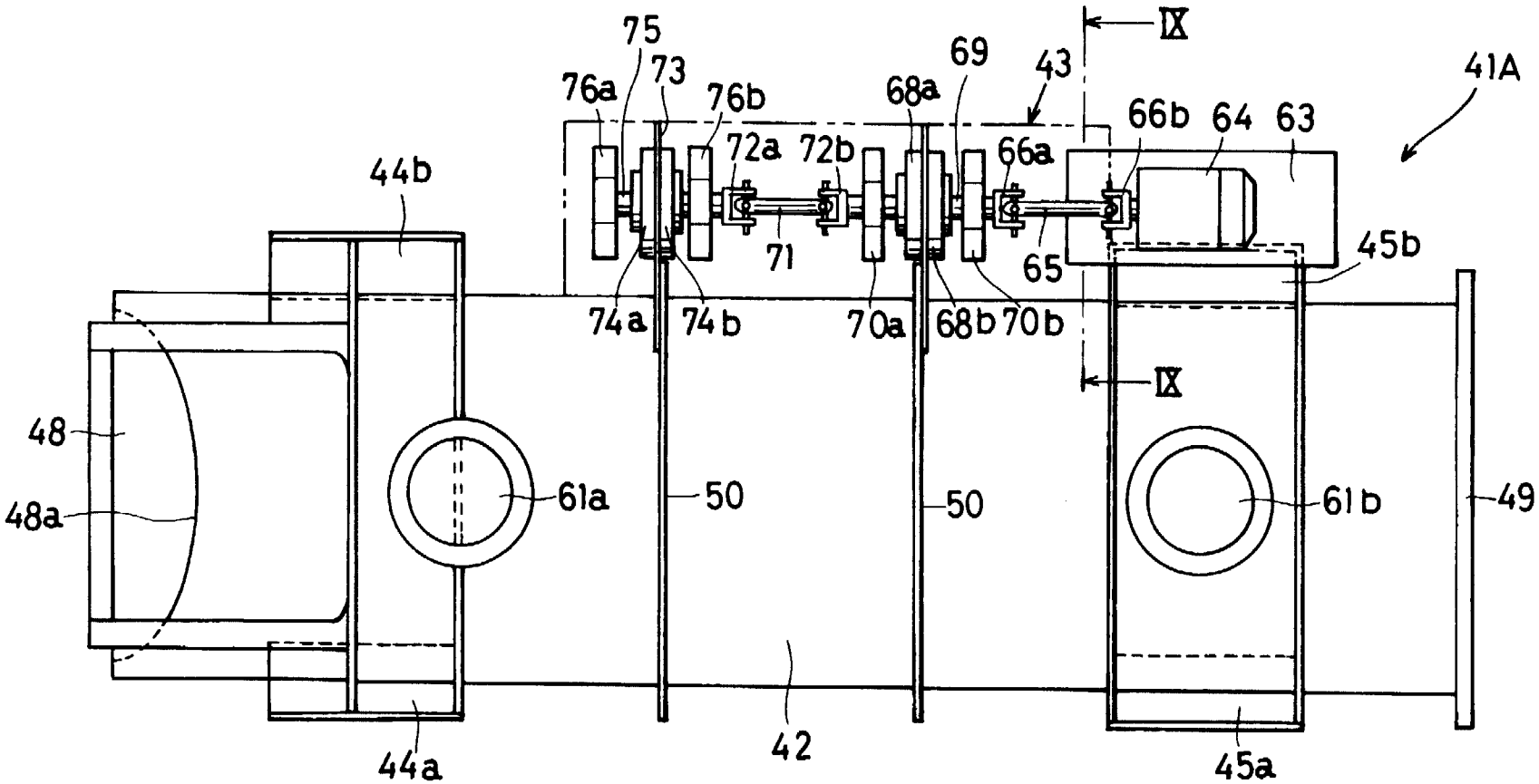
FIG. 7 is a plan view of the vibratory drum machine of FIG. 6.
Figure 8:
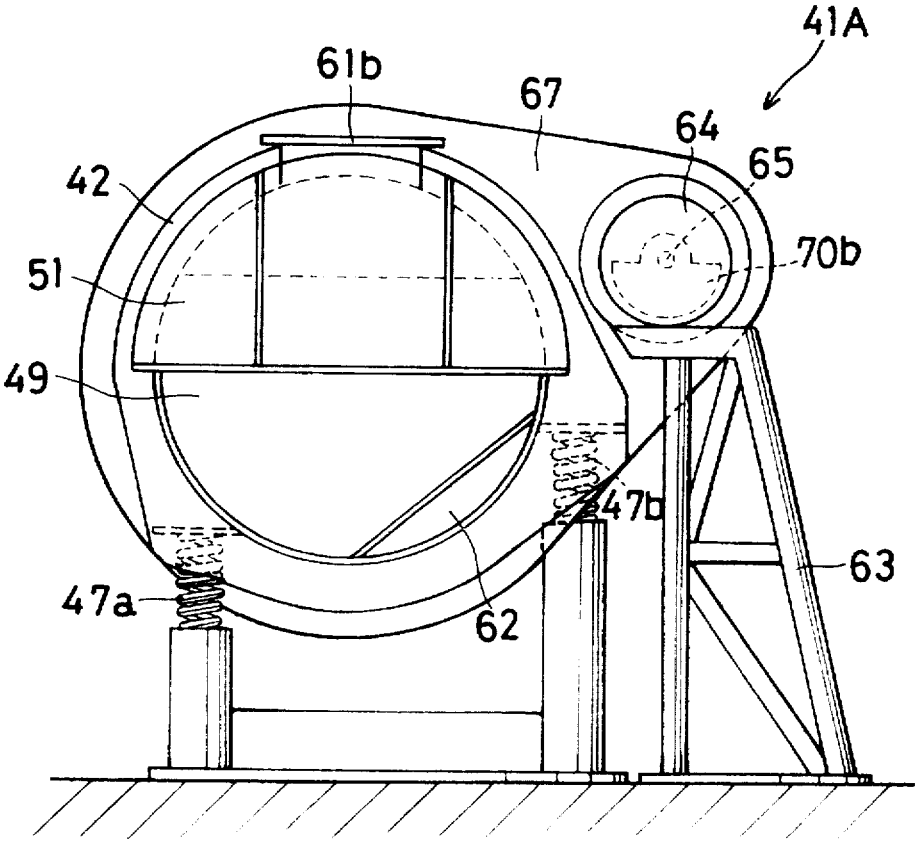
FIG. 8 is front view of the vibratory drum machine of FIG. 6.
Figure 9:
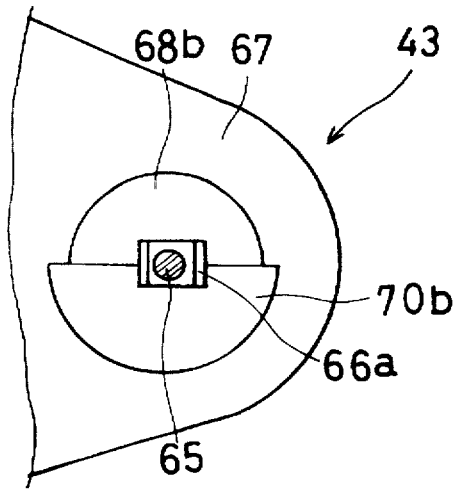
FIG. 9 is an enlarged cross-sectional view taken along the line IX—IX in FIG. 7.

Next, there will be described the detail of the vibratory exciter 43 particularly with reference to FIG. 7 to FIG. 9.

The vibratory exciter 43 generates a circular vibratory force. An electric motor 64 is mounted on a supporting frame 63 arranged at the one side of the drum body 42. It is a drive source. A first link 65 is combined through a universal joint mechanism to a end portion of the rotary shaft of the electric motor 64. Thus, the drive shaft of the electric motor 64 is combined through a universal joint 66*b* to a first link 65. A left end portion of the first link 65 is combined through a universal joint 66*a* to a first support axis 69. The first support axis 69 is fitted to inner races of a pair of bearings 68*a* and 68*b* fixed at both sides of the mounting plate which is fixed to the drum body 42. A substantially semi-circular unbalance weight 70*a* is fixed to one end portion of the first support axis 69. Another unbalance weight 70*b* having the same shape as the unbalance weight 70*a* is fixed to another end portion of the first support axis 69.

The first support axis 69 is combined through universal joints 72*a*, 72*b* and a secondary link 71 with a second support axis 75. A pair of bearings 74*a* and 74*b* is fixed to a support plate 73 which is, in turn, fixed to the peripheral wall of the drum body 42. The second support axis 75 is rotatably fitted into inner races of the bearings 74*a* and 74*b*. Unbalance weights 76*a* and 76*b* having the same shape as the above described unbalance weights 70*a* and 70*b* are fixed to end portions of the second support axis 75.

According to this invention, a line L—L which connects a center P of the circular vibrating force, therefore a central axis of the drive shaft (link) 65 with a central axis C of the drum body 42 is so designed as to make an angle β of 25 degrees relative to a horizontal line H—H. The heights of the mounting frame 63 and the shape of the mounting plate 67 are so designed as to obtain the above described angle of 25 degrees. Further, according to this embodiment, the rotational direction of the electric motor 64 for driving the drive shaft (link) 65 is in the clockwise direction.

A pair of observing windows 61*a*, 61*b* is formed on the upper wall portion of the drum body 42. As shown in FIG. 8, an arcuate stop plate 62 is fixed at the bottom portion of the inside wall of the drum body 42 near the outlet 49.

Next, there will be described operations of the above described vibratory drum machine 41A according to the first embodiment of this invention.

Although not shown, cast components to be cooled and cleaned, are supplied into the inlet 48 of the drum body 41. The electric motor 64 is driven. The rotary force of the drive shaft of the electric motor 64 through the universal joints 46*a*, 46*b* and the first link 65 drives the pair of the unbalance weights 70*a* and 70*b*. Further, the first support axis 69 fixing the unbalance weights 70*a* and 70*b* drives the unbalance weights 76*a* and 76*b* fixed to the end of the second support axis 75 through the universal joints 72*a*, 72*b* and second link 71. A centrifugal force or a circular vibratory force is generated around the central axis of the support axes 69, 75 with the rotation of the unbalance weights 70*a*, 70*b*, 74*a* and 74*b*. It is transmitted to the drum body 42 to vibrate the latter in the following manner. The rotational shaft of the electric motor 64 is combined through the universal joint 66*a* and 66*b* with the unbalance weights 70*a* and 70*b*. Further, the first support axis 69 is combined through the universal joint 72*a* and 72*b* with the unbalance weights 76*a* and 76*b*. Accordingly, the vibration is scarcely transmitted to of the drum body 42 the electric motor 64. Thus, the electric motor 64 continues stably to rotate.

Figure 10:
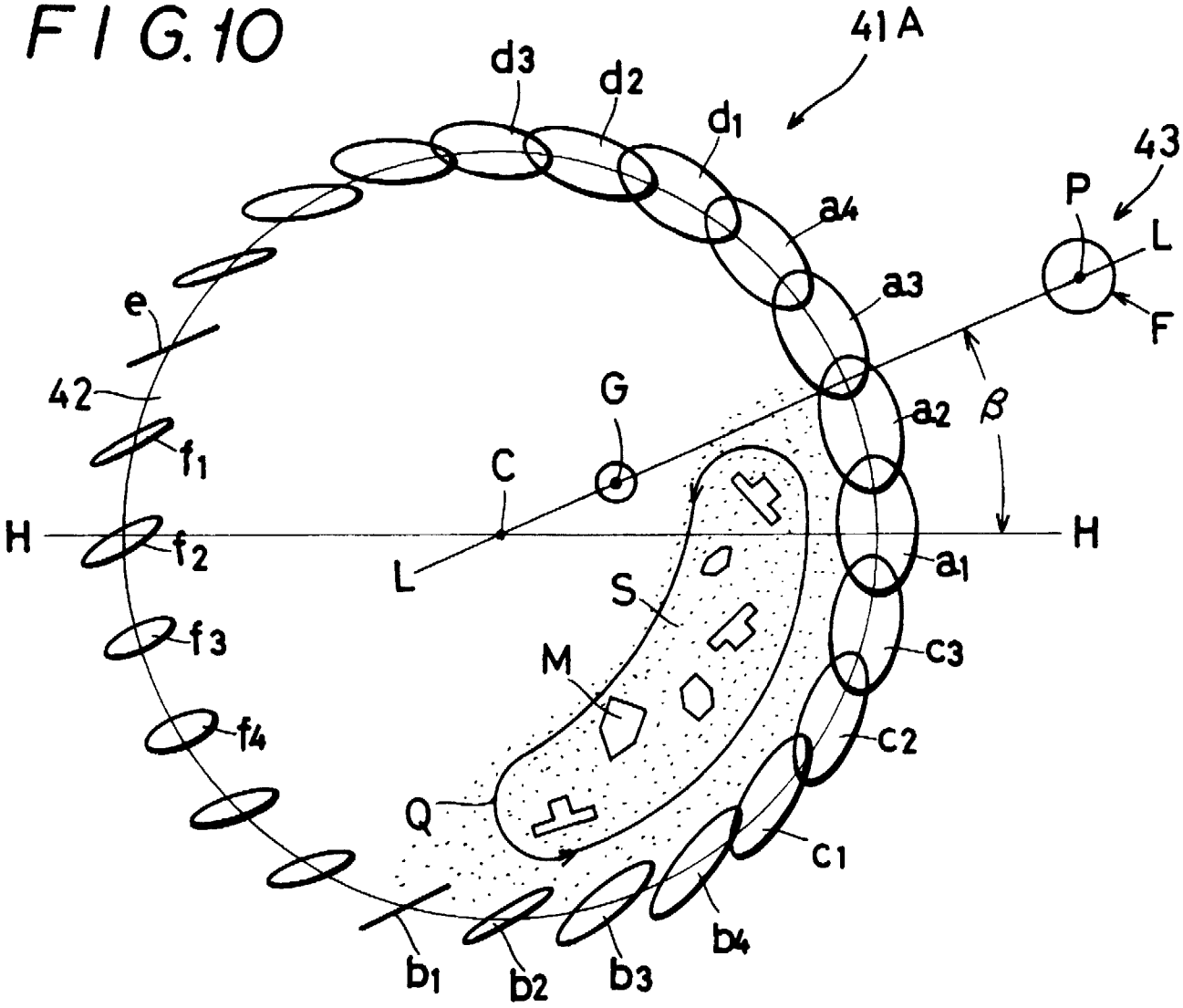
FIG. 10 is a cross-sectional schematic view of the vibratory drum machine of the first embodiment.

FIG. 10 shows relationships among the central axis C of the drum body 42, a gravity center G of the whole drum body 42 and the central point P of the circular vibratory force of the exciter 43. The circular vibrating force F as shown in FIG. 10 is generated with the drive of the exciter 43. A rotational moment is generated around the gravity center G. The drum body 42 is represented by a circular line in FIG. 10. The distance between the central point P of the circular force F and the peripheral wall of the drum body 42 is shown in FIG. 10. Points on the peripheral wall of the drum body 42 vibrate in the shown manners. Some points on the peripheral wall portion of the drum body 42 nearest to the exciter 43 vibrate elliptically in the manners as shown by $a_1$, $a_2$, $a_3$, and $a_4$. Long axes of the elliptical vibrations $a_1$, $a_2$, $a_3$ and $a_4$ and short axes thereof on the points near the exciter are larger than thoes of elliptic vibrations on other points on the peripheral wall portion of the drum body 42. Further, the inclinations of the long axes of the elliptic vibrations of the points on the peripheral wall portion of the drum body 42 are changed along the peripheral wall in the manners as shown in FIG. 10. Points on the bottom wall portion of the drum body 42 vibrate linearly or elliptically as shown by $b_1$, $b_2$, $b_3$ and $b_4$. The directions of the long axes of the elliptic vibrations $b_1$, $b_2$, $b_3$ and $b_4$ are so inclined as to impart a forward movement to the cast components M and sands S in the counterclockwise direction relative to the inside wall surface of the drum body 42. Points near the top end wall portion of the drum body 42 vibrate in in elliptical forms as shown $d_1$, $d_2$, $d_3$—. The long axes of the elliptic vibration $d_1$, $d_2$and $d_3$ and short axes thereof become smaller in the order of the $d_1$, $d_2$, $d_3$—. Further, the locus of the elliptical vibrations $b_2$, $b_3$, $b_4$, $c_1$, $c_2$—rotate in the clockwise directions in FIG. 10. The vibrations $d_1$, $d_2$, and $d_2$ are elliptical and the locus of thereof rotate in the clockwise direction. However, the directions of the long axes of the elliptic vibrations $a_1$, $a_2$ and $a_3$ are substantially parallel to the tangent line on the points of the inside peripheral surface of the drum body 42. Accordingly, the movement force by vibration is almost zero above the points. In FIG. 10, a linear vibration as shown by e is made at an angle of about 170 degrees with respect to the vibration $a_1$ and the central axis C of the drum body 42 in the counterclockwise direction. Elliptic vibrations $f_1$, $f_2$, $f_3$ and $f_4$ are obtained between the bottom portion of the inside wall portion and the angle position of about 170 degrees. The long axes of the elliptic vibrations $f_1$, $f_2$, $f_3$ and $f_4$ and the short axes thereof become larger in that order. The rotation of the locus of the elliptic vibrations $f_1$, $f_2$, $f_3$ and $f_4$ are in the counterclockwise direction. A linear vibration $b_1$ is made at the most lower portion of the inside wall of the drum body 42. In the counterclockwise direction from the bottom point of the inner wall of vibratory drum body 42, the above described elliptic vibration are made. The rotations of the locus of the elliptic vibrations are in the clockwise directions.

The above vibration modes have been obtained by an electronic computer. The original point of X–Y rectangular coordinates-abscissa is made to be equal to the central axis C of the drum body 42. The dimensions of respective parts of the vibratory drum machine are followings:

| | |
|---|---|
| Diameter of the drum body | D (CM) 120.0 |
| Weight of the whole vibratory drum machine | W (Kg) 1970.0 |
| Inertial moment around the gravity center of the vibratory drum machine | AI (KgSqCM) 8820000.0 |
| X coordinate of the gravity center of the whole vibratory drum machine | XM (CM) 18.3 |
| Y coordinate of the gravity center of the whole vibratory drum machine | YM (CM) 7.6 |
| X coordinate of the position of the exciter | SS (CM) 38.3 |
| The number of the vibration | M (RPM) 900.0 |
| The amplitude at the most lower portion of the vibratory drum | AT (mm) 9.0 |
| Exciting force | F (Kg) 5664.7 |

Figure 6:
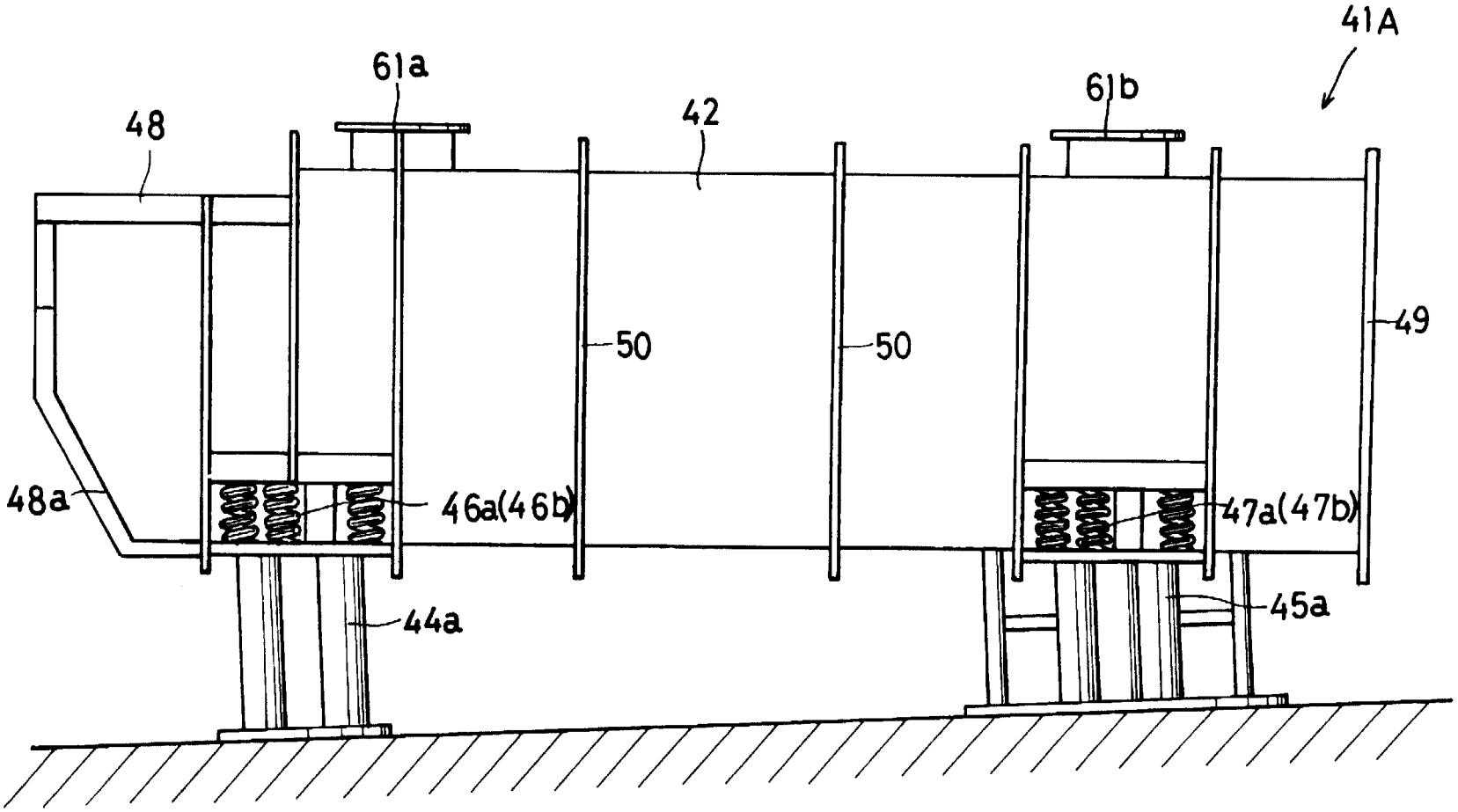
FIG. 6 is a side view of a vibratory drum machine according to a first embodiment of this invention.

The cast components M and sands S supplied through the inlet 48 of the drum body 42 are subject to the above described vibrations in the inside of the drum body 42. The drum body 42 is downwards inclined at the angle of about 2 to 3 degrees. Accordingly, they are moved rightwards in FIG. 6. As shown in FIG. 10, the cast component M and sands S are moved upwards along the inside wall surface of the drum body 42 in the counterclockwise direction. When they are moved up to a predetermined level of the drum body 42, the gravitational force becomes larger than the movement force by the vibrating force. Accordingly, the cast components M and sands S slide down along the upper layer of the cast components M ans sands S. As the result, the cast components M and sands S move as shown by the arrow Q. In the circulating motion, the cast components M and sands S are sufficiently stirred and moved rightwards along the central axis C (FIG. 6). The sands S are sufficiently separated from the cast components M and the cooling operation is sufficiently effected. The cooled and cleaned cast components M and sands S are discharged outwards through the discharging outlet 9. As shown in FIG. 8, the arcuate stop plate 62 is arranged along the inside wall surface of the vibratory drum 42. Accordingly, the cast components M and sands S can be sufficiently stirred in a long time within the vibratory drum 42 and then they are discharged through the discharge outlet 49. If there is no stopping plate 62 and occupation rate of the cast components M and sands S in the internal space of the drum body 42 is small, the cast components M and sands S could not receive sufficient stirring operation and are discharged through the outlet 49. Accordingly, the effect of the stop plate 62 is remarkable in the case when the occupation rate of the cast components and sand in the drum body 42 is small. In the above described manner, the cast components M to be cleaned and cooled are stirred and moved. The vibrations $b_1$, $b_2$, $b_3$, $b_4$, $c_1$, $c_2$—of the points of the peripheral wall of the drum body 42 can be obtained under the no-load condition in which no cast components M and sands S are supplied. Even when the cast components M to be cooled and cleaned are supplied at the occupation rate as shown in FIG. 10, the amplitude decrease is very small in comparison with the prior art vibratory drum machine. The above described vibration modes $b_1$, $b_2$, $b_3$—change little from the no-load condition to some load condition. The amplitudes become a little small. Thus, the cast components M is subject to the below-described moving force.

The points on the most lower of the inside wall of the drum body 42 effect the linear vibration $b_1$. The inclination of the vibration $b_1$ is upward to the right side relative to the tangent line to the point on the peripheral wall surface of the vibratory drum 42. As well-known, such a linear vibration gives the cast components M and sands S a large transporting force. Thus, the cast components M to be cleaned and cooled move fast and they are moved upwards in the counterclockwise direction in FIG. 10. Further, the long axes of the elliptic vibrations $b_2$, $b_3$, $b_4$, $c_1$— and the short axes thereof become larger in the counterclockwise direction as shown in FIG. 10. The directions of the long axes of the elliptic vibrations $b_2$, $b_3$ and $b_4$ make vibration angles to impart transporting forces to the cast components M relative to the tangent line on the point of the peripheral wall of the drum body. Also in these points, the cast component M and sands S receive the large moving forces. They are moved in the counterclockwise direction. They rise up to some height along the inside wall surface of the drum body 42. The elliptic vibrations $c_1$, $c_2$ and $c_3$ make small vibratory angles relative to the tangent line to the points on the peripheral inside wall. Accordingly, the forward movement speed by the vibratory force on these points is very small along the inside wall. Small movement in the counterclockwise direction with respect to the peripheral wall of the drum body 42 is imparted to the cast components M and sands S. The point on the peripheral wall vibrates in the manner as shown by $a_1$ at the angular position of about 90° in the counterclockwise direction from the most lower wall portion of the drum body 42. The long axis of the elliptic vibration $a_1$ is substantially parallel to the tangent line on the point on the peripheral wall. Little transporting force is imparted to the cast components M and sands S along the inside wall. Further, in the positions distant in the counterclockwise direction from the angle 90°, the directions of the long axes of the elliptic vibrations $a_2$, $a_3$, $a_4$ are inverted relative to the tangent line on the points on the peripheral wall, with respect to the elliptical vibrations $c_1$, $c_2$, $c_3$—. Accordingly, the transporting direction is inverted. Thus, the cast components M and sands S are moved in the clockwise direction. If the cast components M and sands S are transported along the wall by the above described vibratory forces $a_2$, $a_3$ and $a_4$, the forward movement speed of the cast components M and sands S by the elliptic vibrations $c_1$, $c_2$, $c_3$ would be decreased. However, actually they drop towards the bottom portion by the gravitational force.

In the above described manner, the cast components M to be cleaned and cooled, occupying at the rate as shown in FIG. 10 are stirred and moved rightwards (FIG. 6), along the central axis C of the vibratory drum body 42. As the result, helical motion is imparted to the cast components M and sands S and the sands S are separated from the cast components M by the helical motion. As water is evaporated from the cast components, latent heat is taken from the cast components M and so they can be cooled. Then the cast components M and sands S are discharged outwards.

In this embodiment, the points in the region between the most lower portion of the inside wall of the drum body 42 and the upper position of about 90 degrees in the counterclockwise direction vibrate in the above described manner. The directions of the long axes of the elliptic vibrations are able to impart forward movement to the cast components M and sands S. Further, rotational direction of the locus of the elliptical vibrations are clockwise in FIG. 10. Accordingly, the forward movement force is larger and the cast components M and sands S can be effectively stirred. Further, in this embodiment, the amplitudes of the long axes of the elliptic vibrations and short axes thereof are changed little under the load condition in comparison with the no-load condition. Accordingly, it can be considered that the vibration mode as shown in FIG. 10 are imparted to the cast component M and sands S in the drum body 42. The reason for the little decrease of the amplitudes is as followings:

The vibratory angles of the long axes of the elliptic vibrations $c_1$, $c_2$, $c_3$, $a_4$ are very small relative to the tangent lines. However, the amplitudes of the short axes of the elliptic vibrations $c_1$, $c_2$, $c_3$ and $a_4$ become sufficiently large. Accordingly, a large acceleration can be obtained in this direction. When the acceleration is more than 1 G, the cast components M can be jumped from the inside wall surface of the drum body 42 in the direction perpendicular to the tangent line on the inside peripheral wall.

Thus the cast components M to be cooled and cleaned can be effectively stirred in the inside space of the drum body 42.

Figure 5:
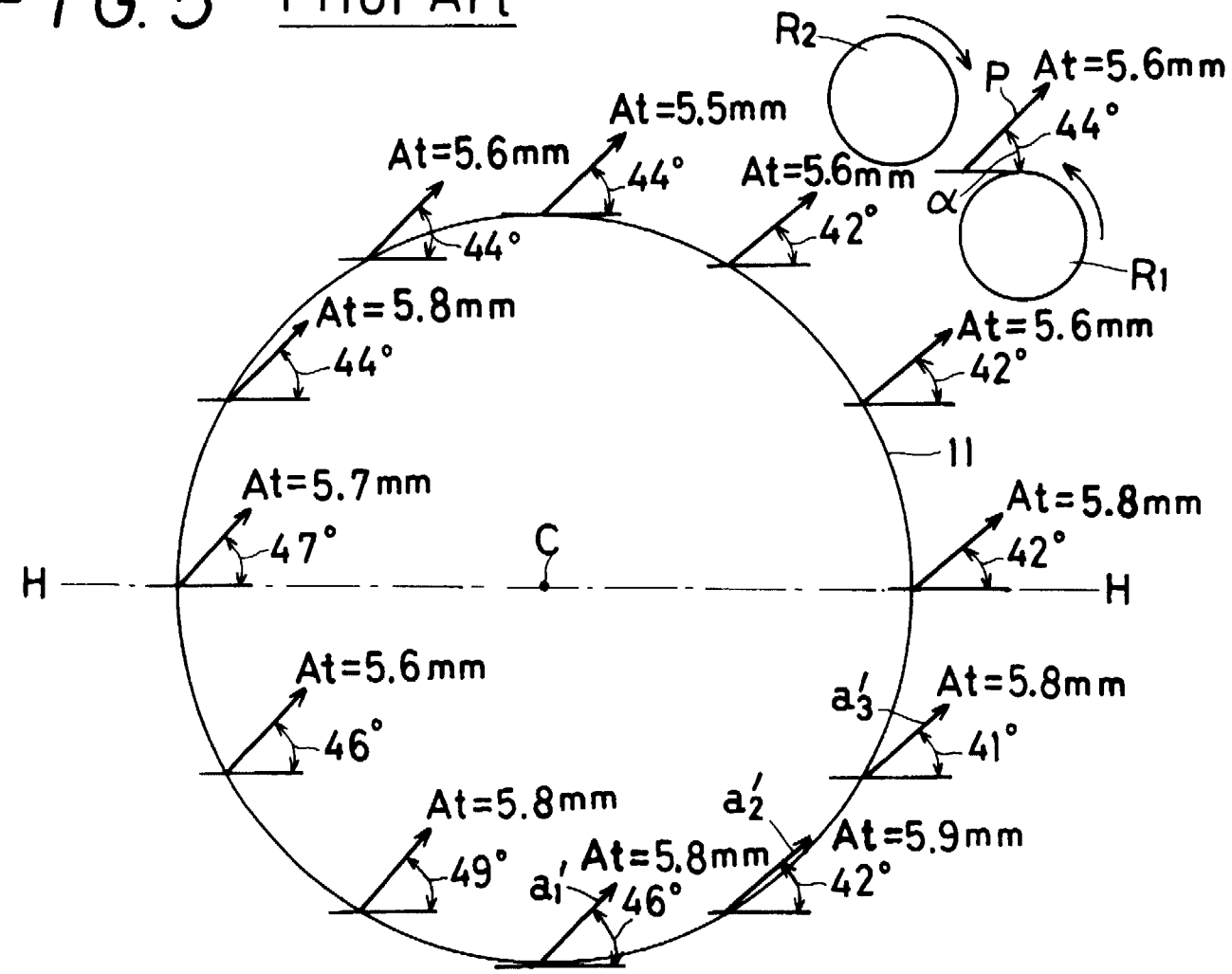
FIG. 5 Prior Art
FIG. 5 is a cross-sectional schematic view of the other prior art for explaining the operations.

In the prior art of FIG. 5, linear vibratory forces are supplied to the respective points on the peripheral wall of the drum body 11. A forward movement force to the cast components M become small in the region between the most lower wall portion and the position of 90° in the counterclockwise direction. Further, the vibratory angles of the linear vibrating forces $a_1'$, $a_2'$, and $a_3'$ are inverted in the region between the most lower wall portion and the position of about 45 degrees in the counterclockwise direction. Accordingly, the forward movement in the clockwise direction is imparted to the cast components M for this reason. Thus, the cast components M are subject to the counterclockwise movement at the most lower wall portion. In the region between the most lower wall portion and the position of 45°, the cast components near the most lower wall portion push the cast component at the positions of the about 45 degrees and the cast components M pushe the peripheral wall of the drum body 42. The cast components M, sands S and the drum body 42 move as if they forms integrally with each other as one rigid body. The effective mass is increased. Even when the vibratory force is the same, the amplitude of the drum body 42 in the load condition is changed much from the amplitude in the no-load condition. Accordingly, in order to obtain the load condition as shown in FIG. 10, the linear vibratory force should be larger. However, in this embodiment, the amplitude in the load condition is changed little from the amplitude in the no-load condition. Thus, the driving force can be small in contrast to the prior art.

Figure 12:
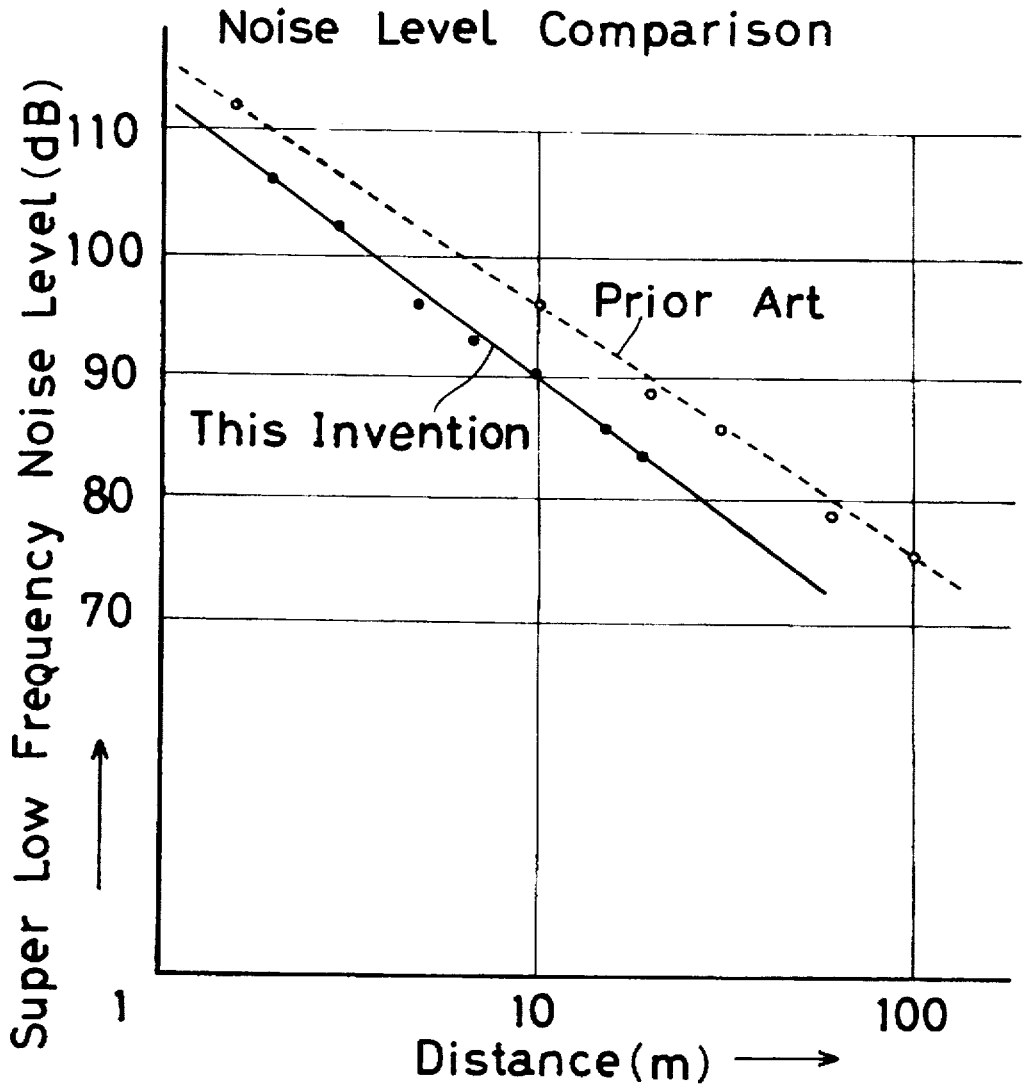
FIG. 12 is a graph for comparing the noise levels between the prior art and the first embodiment of this invention.

The experimental results shown in FIG. 12 were obtained from the comparison between the sound levels of the super low frequency (900 r.p.m.) generated from the vibratory drum machine 41A according to this embodiment and those of the prior art. The relationships between the central point of the vibratory drum machine 41A and the point distant by 100 m from the center of the vibratory drum machine 41A are changed in super low frequency noise level dB as shown in FIG. 12 between the prior art and this invention. The prior art characteristic and this embodiment characteristic decrease linearly with the distance from the vibratory drum machine. However, the sound or noise level of the prior art is higher by about 6 dB. Thus the influence on the houses which are distant by 100 m from the vibratory drum machine can be smaller further. As above described, the prior art vibratory drum machine vibrates linearly at the respective points. When the projection of the prior art vibratory drum machine is considered from far, the amplitude of the linear vibration imparts to the houses the public nuisance of super low frequency. However, according to this invention, the points on the peripheral wall of the vibratory drum machine 41A as shown in FIG. 6 vibrate in the elliptical manners as above described. The amplitudes of the short axes of the elliptic vibration are a noise source for a distant point. It can be inferred that the noise level can be decreased for that reason. It is clear from the graph of FIG. 12.

According to the first embodiment, there is no construction of the gear engagement for synchronization of two rotary shafts in contrast to the exciter mechanism of the prior art. Thus, no noise due to engagement of the gears is made in this embodiment. Accordingly, a high frequency noise level is low in contrast to the prior art construction. In this embodiment it is almost "0".

Figure 11:
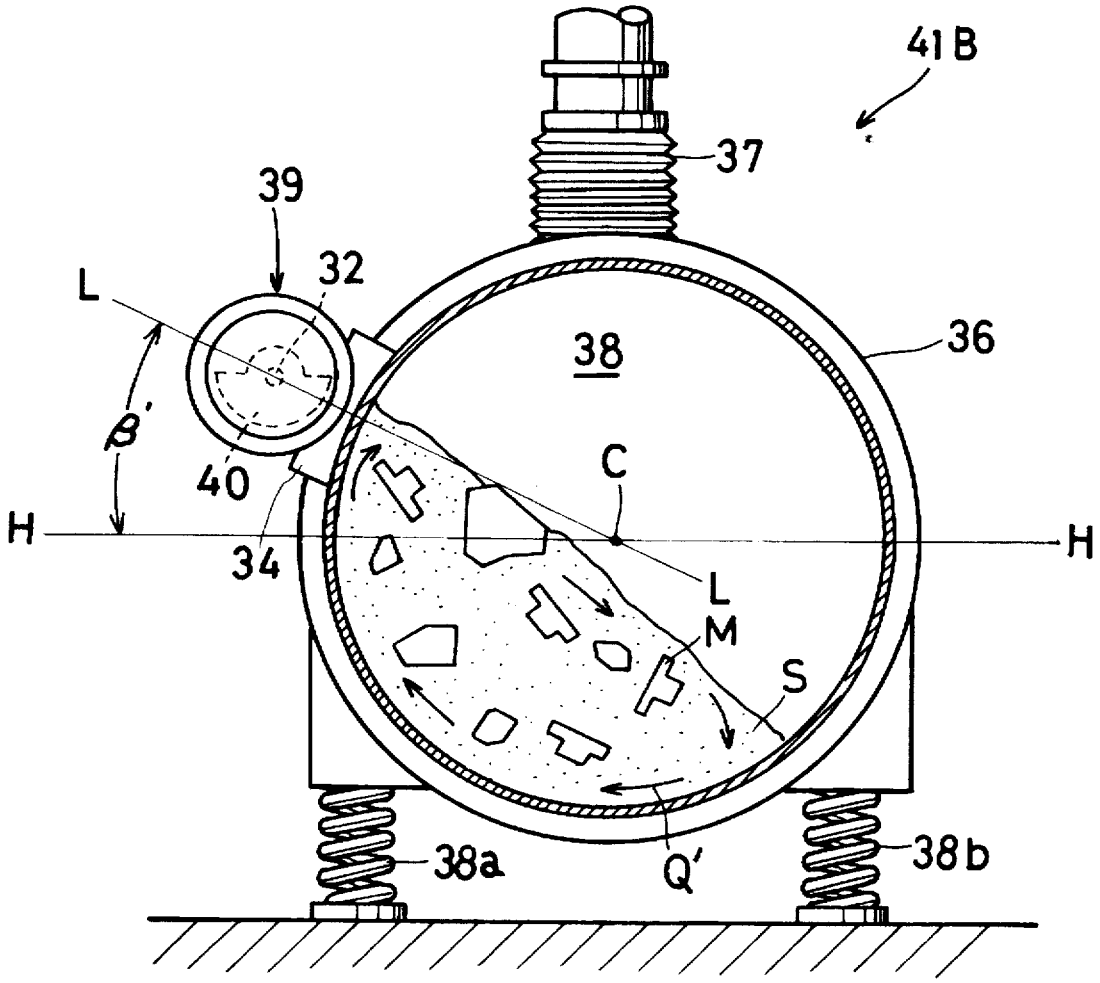
FIG. 11 is a cross-sectional view of a vibratory drum machine according to a second embodiment of this invention, similar to FIG. 2.

FIG. 11 shows a vibratory drum machine 41B according to a second embodiment of this invention. Parts in FIG. 11 which correspond to those in FIG. 10, are denoted by the same reference numerals, the detailed description of which will be omitted.

In this embodiment, one vibratory electric motor 39 is fixed to the peripheral wall portion of a drum body 36 at the angular position which is above the horizontal line H—H but at a left side of the line intersecting the axis C perpendicular to the horizontal line H—H. The line connecting the center axis of a rotary shaft 32 of the vibratory electric motor 39 with the central axis C of the drum body 36 makes the same angle β' of 25 degrees. Semi-circular unbalance weights 40 are as in the first embodiment fixed to both ends of the rotary shaft 32 of the vibratory electric motor 39. The central axis of the rotary shaft 32 is the center of a circular vibratory force. It is clear that this construction has the same effect as the first embodiment. However, in this embodiment, the rotational direction of the rotary shaft 52 is in the clockwise direction (FIG. 11). Accordingly, the rotational direction of the locus of elliptic vibrations on the respective points on the peripheral surface of the drum body 36 is in the counterclockwise direction in contrast to the first embodiment. The cast components M and sands S receive a forward movement force in the clockwise direction from the bottom wall of the drum body 2. Thus, the cast components M and sands S to be cooled and cleaned circulate in the drum body 36 in the manner as shown by the arrow Q'.

Figure 13:
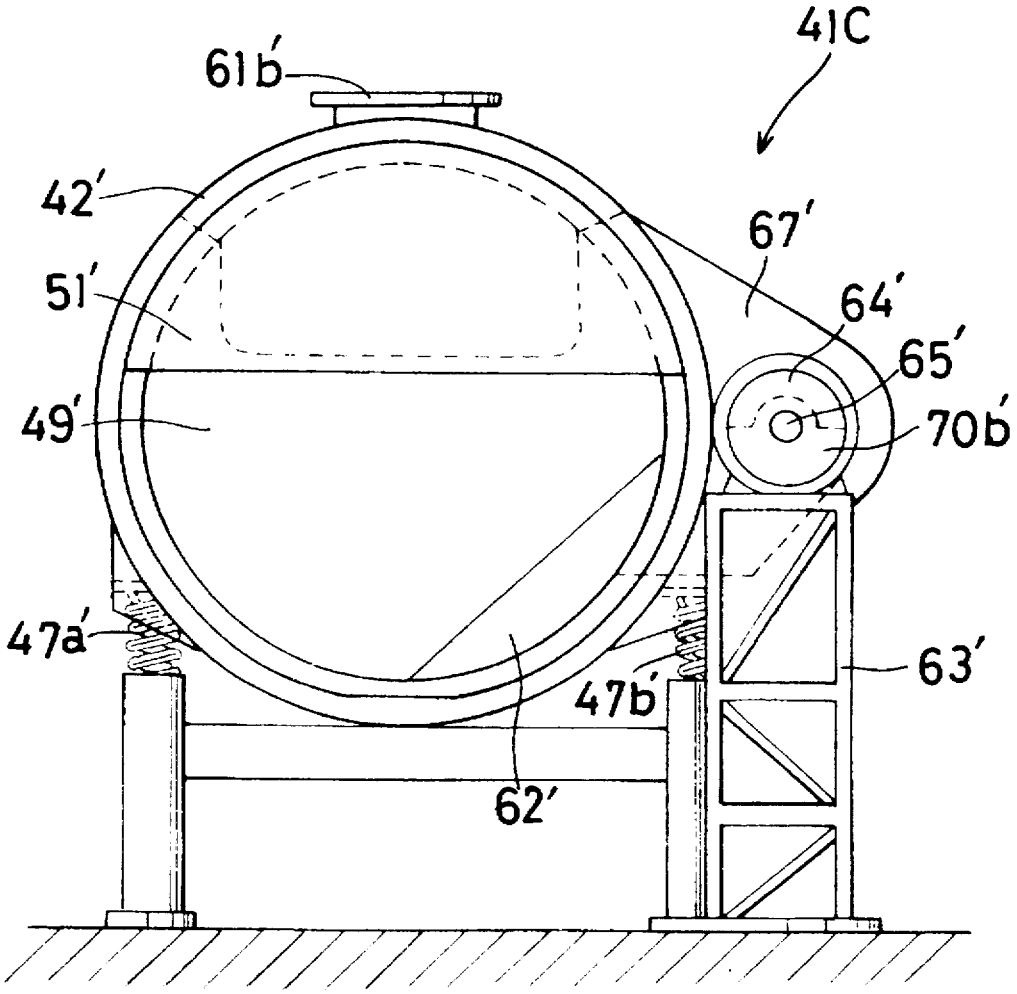
FIG. 13 is a front view of a vibratory drum machine according to a third embodiment of this invention.

FIG. 13 shows a vibratory drum machine 41C according to a third embodiment of this invention. The parts in FIG. 13 which correspond to those in FIG. 13 of the above embodiment, are denoted by the same reference numerals with dash, the detailed description of which will be omitted. In this embodiment, an exciter is fixed at the peripheral wall of the drum body 42' on the horizontal line H—H. The side view of this vibratory drum machine 41C is the same as that of the vibratory drum machine according to the first embodiment of this invention. Thus, the drum body 42' is so arranged as to be inclined downwards at a few degrees. Materials to be treated are supplied through an inlet formed on the peripheral wall of the drum body 42'. An outlet 49' for discharging the treated materials is formed at the right end portion in the side view.

Figure 14:
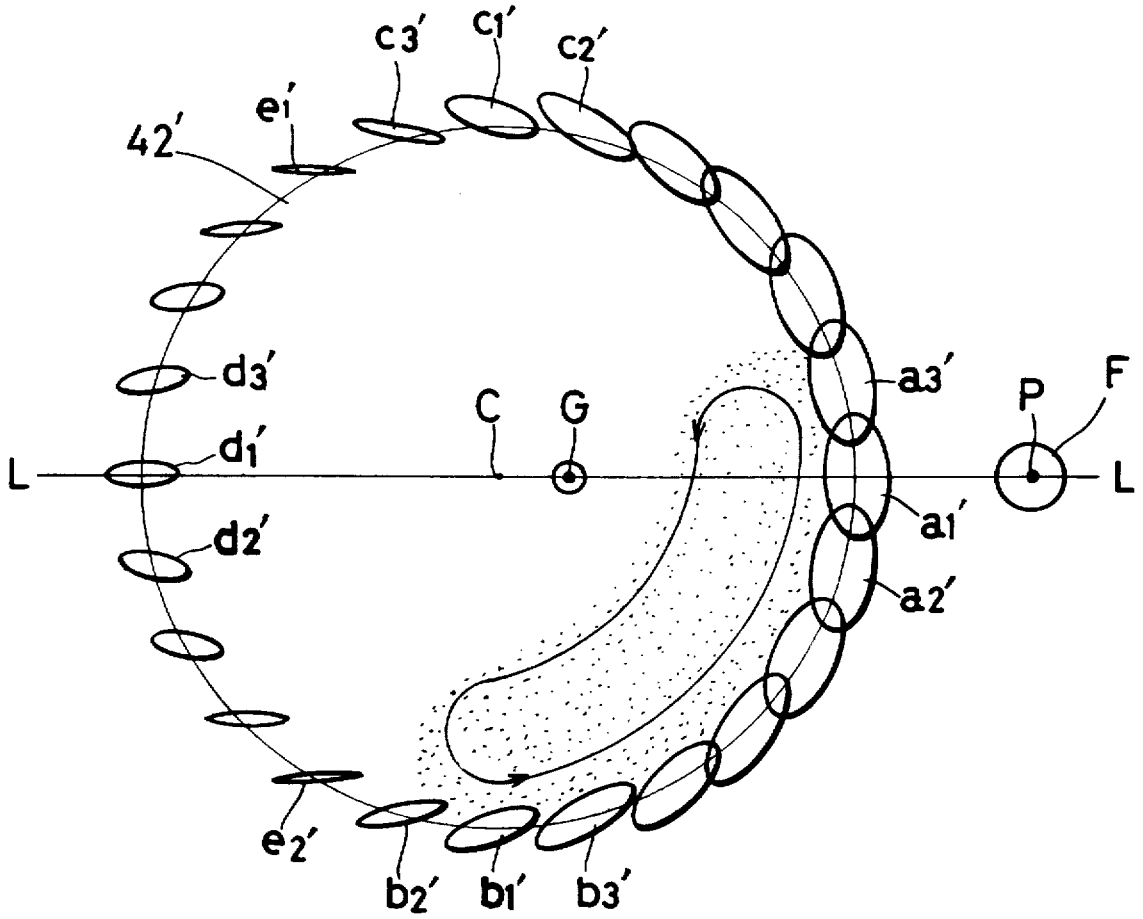
FIG. 14 is a cross-sectional schematic view of the vibratory drum machine of FIG. 13 for explaining the operations.

FIG. 14 shows operations of the vibratory drum machine 41C according to the third embodiment of this invention. The central axis C of the drum body 42', the gravity center G of the whole vibratory drum machine 41C and the center P of the circular vibratory force of the exciter align on the same line L—L, which is equal to the horizontal line. A circular vibratory force F as shown in FIG. 14 is generated with the drive of the exciter.

A rotational moment is generated around the gravity center G. As in the above embodiment, the periphery of the drum body 42' is represented by a circular line in accordance with a distance from the center P of the circular vibratory force F. The respective points on the peripheral wall of the drum body 42' vibrate in the manner as shown by $a_1'$, $a_2'$, $a_3'$, $b_1'$, $b_2'$, $b_3'$—. The points on the peripheral wall of the drum body 42' nearest to the exciter vibrate elliptically as shown by $a_1'$, $a_2'$, $a_3'$. The long axes of the elliptical vibrations $a_1'$, $a_2'$, $a_3'$ and short axes thereof are larger those of the elliptical vibrations on the other points on the peripheral wall. The long axes of the elliptical vibrations $a_1'$, $a_2'$, $a_3'$ are almost perpendicular to the horizontal line L—L. The points on the bottom wall portion of the drum body 42' vibrate elliptically as shown by $b_1'$, $b_2'$ and $b_3'$. The directions of the long axes of the elliptic vibrations $b_1'$, $b_2'$, $b_3'$ are inclined upwards to the right side. The amplitudes of the long axes of the elliptic vibrations $b_1'$, $b_2'$, $b_3'$ are smaller than those of the elliptical vibrations $a_1'$, $b_2'$ and $a_3'$. The points on the peripheral wall farthest from the exciter F vibrate elliptically as shown by $d_1'$, $d_2'$ and $d_2'$. The ratio of the long axis to the short axis in the elliptical vibrations $d_1'$, $d_2'$, $d_3'$ are nearly equal to "1". The direction of the long axis of the elliptic vibration $d_1'$ is almost horizontal. The inclination directions of the long axes of the elliptical vibrations $d_2'$, $d_3'$ are opposite to each other and they make small angle with the horizontal line. The points on the top portion of the peripheral wall of the drum body 42' vibrate elliptically as shown by $c_1'$, $c_2'$ and $c_3'$. The direction of the long axis is inclined upwards to the left side. The amplitude of the short axis of the elliptical vibrations become smaller in the order of $c_1'$, $c_2'$, and $c_3'$. Thus, the elliptical vibrations $c_2$, $c_1'$ and $c_3'$ approach linear vibratory motions. And the points on the peripheral wall farthest both from the top or bottom portion of the drum body 42' and the exciter F vibrate as shown by $e_1'$, $e_2'$. These vibrations are almost of linear vibratory motion. The directions of the vibrations $e_1$, $e_2$ are opposite to each other.

The original point of the X–Y right coordinate-abscissa is the center C of the cross-section of the drum body 42'. The dimensions of the vibratory drum machine 41C are as followings: The vibration modes shown in FIG. 14 were obtained from an electronic computer.

| | |
|---|---|
| Diameter of the drum body | D (CM) 200.0 |
| Weight of the whole of the vibratory drum machine | W (Kg) 15000.0 |
| Intertial moment around the gravity center of the vibratory drum machine | AI (kgSqCM) 150000000.0 |
| X coordinate of the position of the gravity center of the whole vibratory drum machine | XM (CM) 20.0 |

-continued

| | |
|---|---|
| Y coordinate of the position of the gravity center of the whole vibratory drum machine | YM (CM) 0.0 |
| X coordinate of the position of the center of the vibratory force | S (CM) 150.0 |
| Y coordinate of the position of the center of the vibratory force | SS (CM) 0.0 |
| The number of vibration | M (RPM) 900.0 |
| Amplitude of the point at the lowest drum body | AT (mm) 9.0 |
| Vibration force | F (kg) 35009.2 |

Pulverized material M supplied from the inlet is transported rightwards (in side view) since vibratory drum body 42' is so arranged as to be inclined downwards at the angle of about 2 to 3 degrees, receiving the above described vibrations from the inside wall of the drum body 42'. During the transporting, the material M receive the upward force in the counterclockwise direction (FIG. 14) along the inside surface of the drum body 42'. The material M rises up to a certain level along the inside surface of the drum body 42' and the gravitational force becomes larger than the upward movement force. Accordingly, the material M slide down on the upper layer of the material M from the certain level. As the result, the material M circulates as shown by the arrow while the material M is transported rightwards (in side view) and sufficiently stirred in the drum body 42'. According to this embodiment, the material M is naturally dried and it is discharged outwards through the outlet 49'. Also in this embodiment, an arcuate stop plate 62' is arranged along the inside wall adjacent to the outlet 49'. After the material M is sufficiently stirred and dried, it is discharged from the outlet 49'. If there is no stop plate 62' and occupation rate of the material M in the drum body 42' is smaller, the stirring operation in the drum body 42' would be insufficient. Thus, the insufficiently dried material M is discharged outwards. Accordingly, the effect of the stop plate 62' is remarkable when the occupation rate of the material M in the drum body 42' is small.

Figure 15:
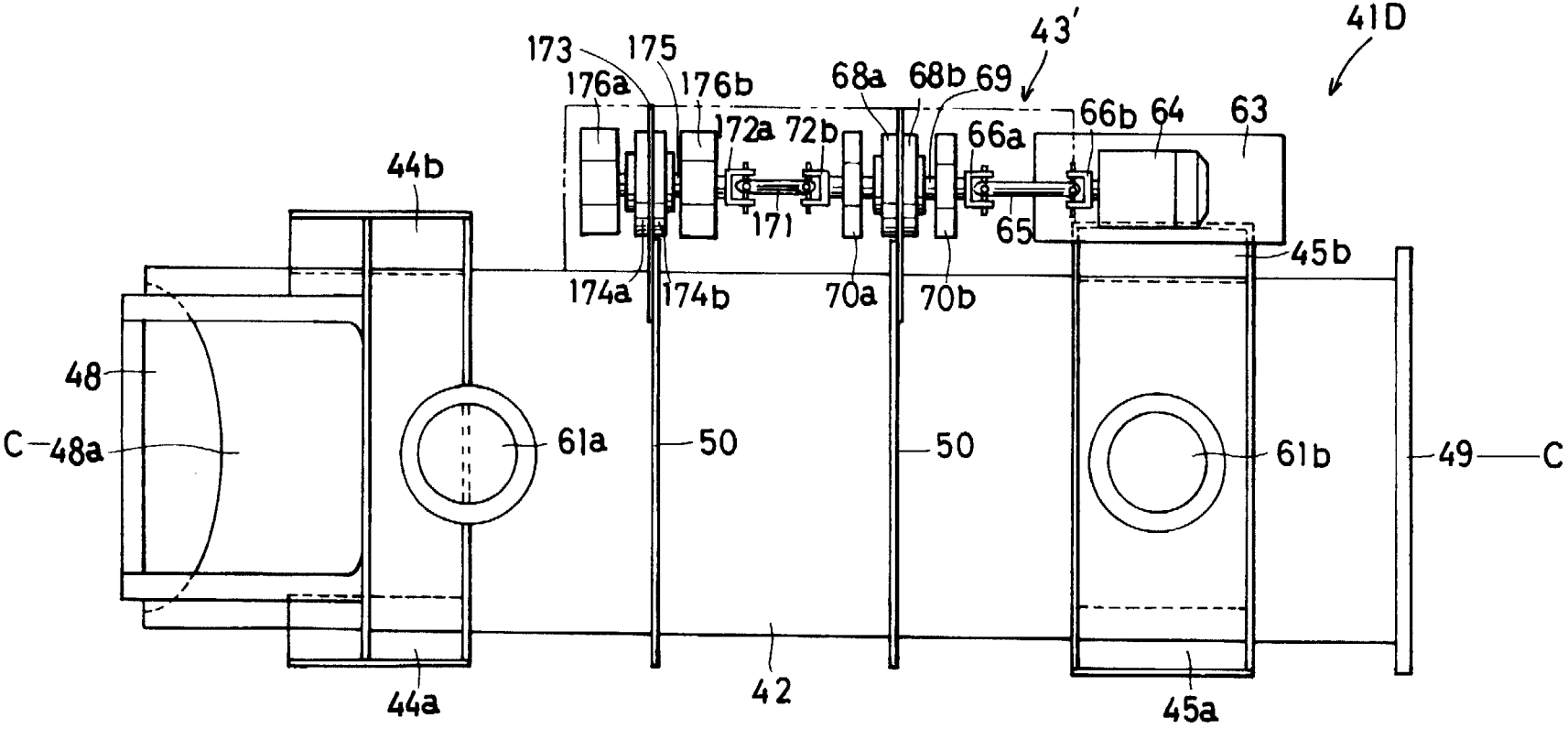
FIG. 15 is a plan view of a vibratory drum machine according to fourth embodiment of this invention.

FIG. 15 shows a vibratory drum machine 41D according to a fourth embodiment of this invention. Parts in FIG. 15 which correspond to those in the above embodiment, are denoted by the same reference numerals, the detailed description of which will be omitted.

In this embodiment, first unbalance weights **70*a*, 70*b* are the same as those in the first embodiment, but second unbalance weights 176*a*, 176*b* are larger than those in the first embodiment. A mass m× distance R between the gravity center of the unbalance weight and the central axis of the rotary shaft, of the second unbalance weights 176*a*, 176*b* are larger that of the first unbalance weights 70*a*, 70*b*. The second unbalance weights 176*a*, 176*b* are fixed to a second support axis 175 which is connected through a second link 171 and universal joint 172*a* to a first support axis 69. Since the m× R of the second unbalance weight 176*a*, 176*b* of this embodiment is larger than that of the unbalance weight 36*a*, 36*b* of the first embodiment, the second support axis 175 is stronger than the second support axis of the first embodiment. Further, bearing constructions 174*a*, 174*b* for supporting the second support axis 175 have higher strength than the bearing constructions 34*a*, 34*b*** of the first embodiment.

An exciter 43' constructed as above described is supported at one side of the drum body 42 as in the first embodiment. A gravity center G of the vibratory drum machine 41D lies almost on the central axis C—C of the drum body 42 as shown FIG. 15. The gravity center G is located almost at the center in the longitudinal direction of the drum body 42. The second unbalance weights **176*a*, 176*b* are located at the side of the inlet 48 with respect to the gravity center G and they are fixed through a mounting plate 173 to the drumm body 42. And the first unbalance weights 70*a*, 70*b* having the smaller m×R are fixed to the support axis 69 supported by the bearings 68*a* and 68*b* which are located at the side of the outlet 49 with respect to the gravity center G. According to this embodiment, the second unbalance weights 176*a*, 176*b* are fixed through the mounting plate 173 to the point between the gravity center G and the inlet 48 and the first unbalance weights 70*a*, 70*b* are fixed through the mounting plate to the point between the gravity center G and the outlet 49. According to this embodiment, the distance between the inlet 48 and the second unbalance weights 176*a*, 176*b* is nearly equal to the distance between the first unbalance weights 70*a*, 70*b* and the outlet 49. The vibratory force by the unbalance weights 176*a*, 176*b* is larger than the vibratory force by the first unbalance weights 70*a*, 70*b***.

Next, there will be described operations of the vibratory drum machine 41D according to the fourth embodiment.

With the drive of the electric motor 64, the unbalance weights **70*a*, 70*b* and 176*a*, 176*b* generate circular vibratory forces. The drum body 42 is vibrated elliptically as shown by $a_1$, $a_2$, $a_3$, $a_4$, $b_1$, $b_2$, $b_3$—in the above embodiment. The long axis of the elliptical vibration and the short axis thereof in the cross-section in which the second unbalance weights 176*a*, 176*b* are fixed through the mounting plate 173 to the peripheral wall of the drum body 42 is similar to those in the cross-section in which the first unbalance weights 70*a* and 70*b* are fixed through the mounting plate to the peripheral wall of the drum body 42, but the formers are larger than the latters under the no-load condition. Accordingly, the cast components and sands to be cooled and cleaned supplied through the inlet receive the similar operation to the first embodiment, but the circulating force of the casting components M and sands S at the side of the inlet is larger than the circulating force of the components M and sands S at the side of the outlet. Thus, the cast components and sands circulate at a higher speed near the inlet 48 than those at the side of the outlet 49. At the initial stage in the drum body 42, the cast components and sands contain more water. Accordingly, in the first embodiment, the circulating speed of the cast components and sands are lower at the initial stage and so they sometimes almost stop in the region adjacent to the inlet 48**. The decrease of the amplitude is large under the load condition.

However, in this embodiment, the circulating speed becomes larger and so the drying effect is higher. Accordingly, the water content of the cast components and sands become smaller at a higher rate in the region adjacent to the inlet 48. The fluidity is improved and the transport speed of the cast components and sands to the discharge side becomes higher. As the result, the thickness of the layer of the cask components and sands become almost equal all over the region between the inlet 48 and outlet 49 along the center line C of the drum body 42.

Figure 16:
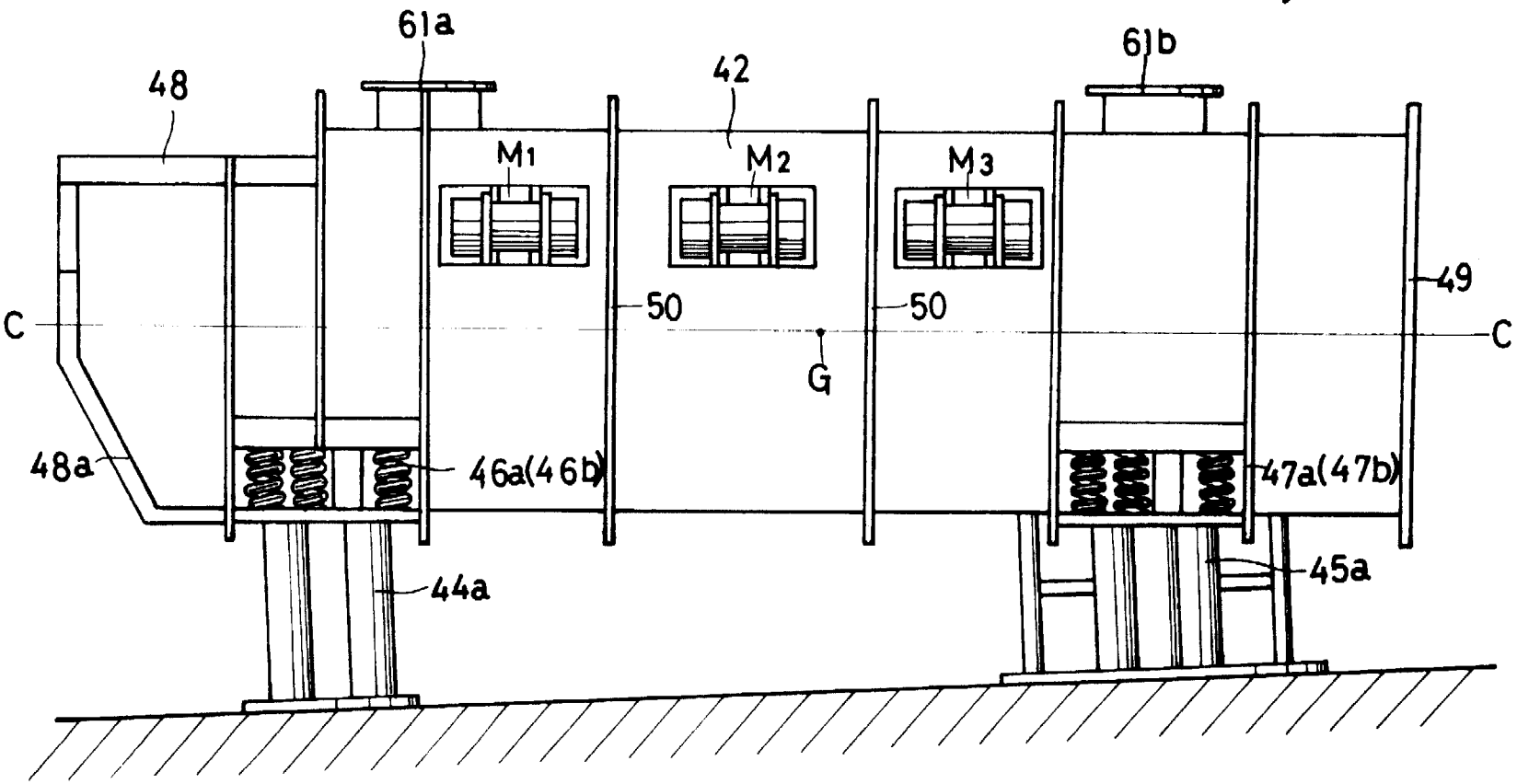
FIG. 16 is a side view of a vibratory drum machine according to a fifth embodiment of this invention.

FIG. 16 shows a vibratory drum machine 41E according to a fifth embodiment of this invention. Parts in FIG. 16 which correspond to those in the above embodiment, are denoted by the same reference numerals, the detailed description of which will be omitted.

In this embodiment, three vibratory electric motors $M_1$, $M_2$ and $M_3$ are fixed at the positions as shown with respect to the gravity center G of the whole vibratory drum machine 41E. The vibratory electric motors $M_1$, $M_2$ and $M_3$ have the well-known constructions. They are arranged eccentrically with respect to the gravity center G of the drum machine 41E so that the exciting force at the side of the inlet 8 is larger than that at the side of the outlet 9. This embodiment has the same effect as the fifth embodiment. The angular position of the vibratory electic motors $M_1$, $M_2$ and $M_3$ onto the peripheral wall of the drum body 42 is equal to that of the first embodiment. Accordingly, this embodiment has the same effect as the first embodiment too.

Figure 17:
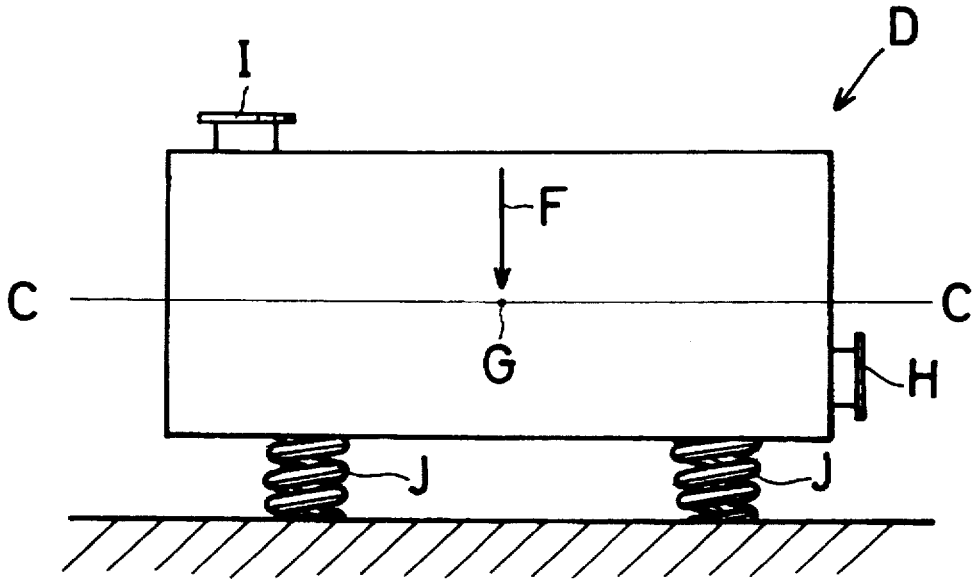
FIG. 17 is a schematic view of a vibratory drum machine for explaining effects of the fifth embodiment.
Figure 18:
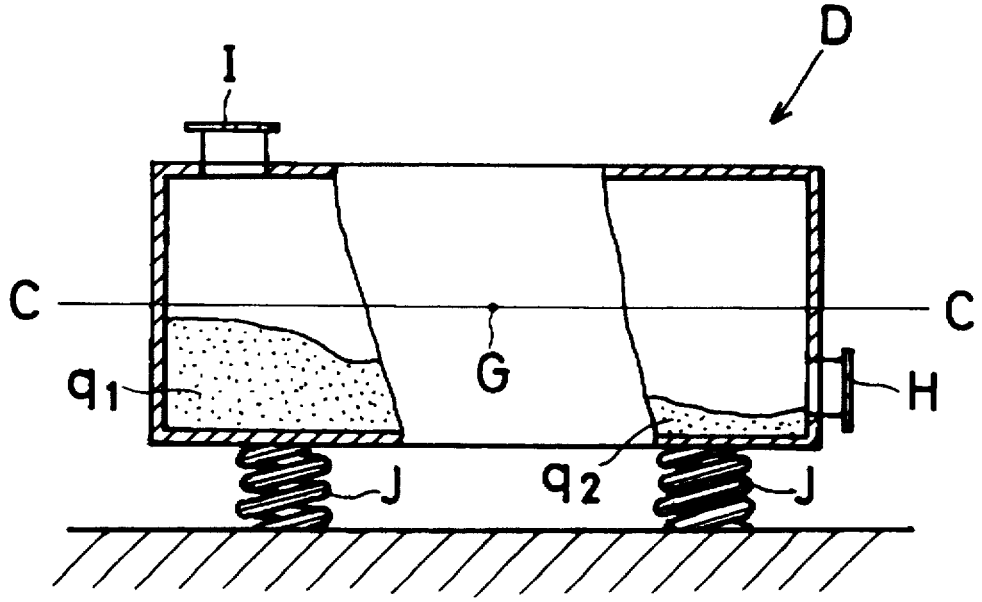
FIG. 18 is a partly-broken schematic view of the vibratory drum machine of FIG. 17.

Next, there will be further described the effects of the above embodiments of FIG. 15 and FIG. 16 with reference to FIG. 17 and FIG. 18.

FIG. 17 shows a schematic side view of the vibratory drum machine D according to the first embodiment. An inlet E is formed at the left end wall portion of a cylindrical drum body. An outlet E is formed at the right end wall portion of the cylindrical drum. The vibratory drum machine D is much simplified in comparison with the vibratory drum machine 41A of FIG. 6.

The gravity center G of the whole vibratory drum machine D is considered to lie on the central axis C—C of the cylindrical drum. The above described exciter is mounted on the vibratory drum, although it is not shown in FIG. 17. F represents the working direction of the force of the exciter. The exciter is so arranged on the vibratory drum that F intersects substantially vertically with the central axis C—C of the vibratory drum, and pass almost through the gravity center G. The casting components M to be cleaned and cooled are supplied through the inlet I into the cylindrical drum body. They are circulated and stirred in the manners as shown in FIG. 10. Water is removed from the casting components M and the latters are cooled. They are transported rightwards in FIG. 17. The casting components M adjacent to the outlet H are further more dried than the casting components M adjacent to the inlet I. Accordingly, the circulating speed of the casting components M nearer to the outlet H is higher than that of the casting components nearer to the inlet I. The transporting speed of the former to the outlet H is higher than that of the latter to the outlet H. Accordingly, the thickness of the layer $q_1$ of the casting components M and the sands S adjacent to the inlet I is larger than that of the layer $q_2$ of the casting components M and the sands S adjacent to the outlet H, as shown in FIG. 18.

Accordingly, the decrease of the amplitudes of the portion of the drum body D adjacent to the inlet I is larger than that of the portion of the drum body D adjacent to the outlet H, when some casting components M to be cleaned and cooled are supplied into the drum body D. The thickness of the layer $q_1$ adjacent to the inlet I becomes larger and larger. That is a vicious circle.

However, the above-described defects can be removed by the above embodiments of FIG. 15 and FIG. 16.

First there will be described a problem to be solved by a sixth embodiment of this invention.

Figure 21:
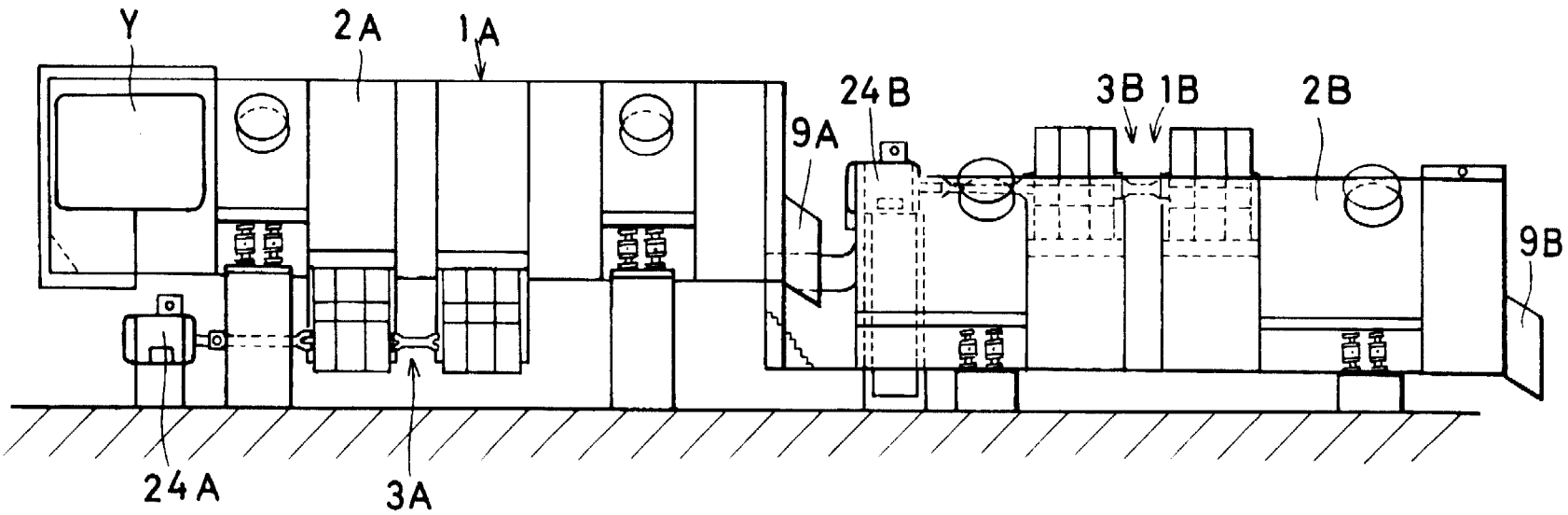
FIG. 21 is a side view of two vibratory drum machines arranged adjacent to each other for explaining the effects of the sixth embodiment.

In FIG. 21, a first vibratory drum machine 1A and a second vibratory drum machine 1B are arranged in series with each other. They are so constructed as the above embodiment or the prior art. Exciters 3A and 3B as in the above embodiment or prior art are fixed on drum bodies 2A and 2B. The vibratory drum machine 1A and 1B are somewhat different from the above embodiments but have principally the same construction. However, the exciter 3A is mounted on the lower portion of the peripheral wall of the drum body 2A. The exciter 3B is fixed almost at the same angular position as in the above first embodiment. The cast components and sands are supplied through the inlet Y formed at the left end portion of the first vibratory drum machine 1A. The cast components to be cooled and cleaned, are supplied through a discharging opening 9A of the first drum machine 2A into the second vibratory drum machine 2B. The sufficiently cooled and cleaned cast components and sands are discharged through an outlet chute 9B of the second vibratory drum machine 1B. As the above embodiment, the exciters 3A, 3B are driven through the flexible shaft by the induction motors 24A, 24B. The induction motors 24*a*, 24*b* are connected to the common commercial supply source. The induction motors 24A, 24B are of the 4 pole type. When the frequency of the comercial supply source is 50 Hz, the induction motors 24A, 24B are rotated, for example, at the frequency of 1450 R.P.M. in accordance with slips, which occurs in accordance with loads applied to the rotary shafts.

Figure 22:
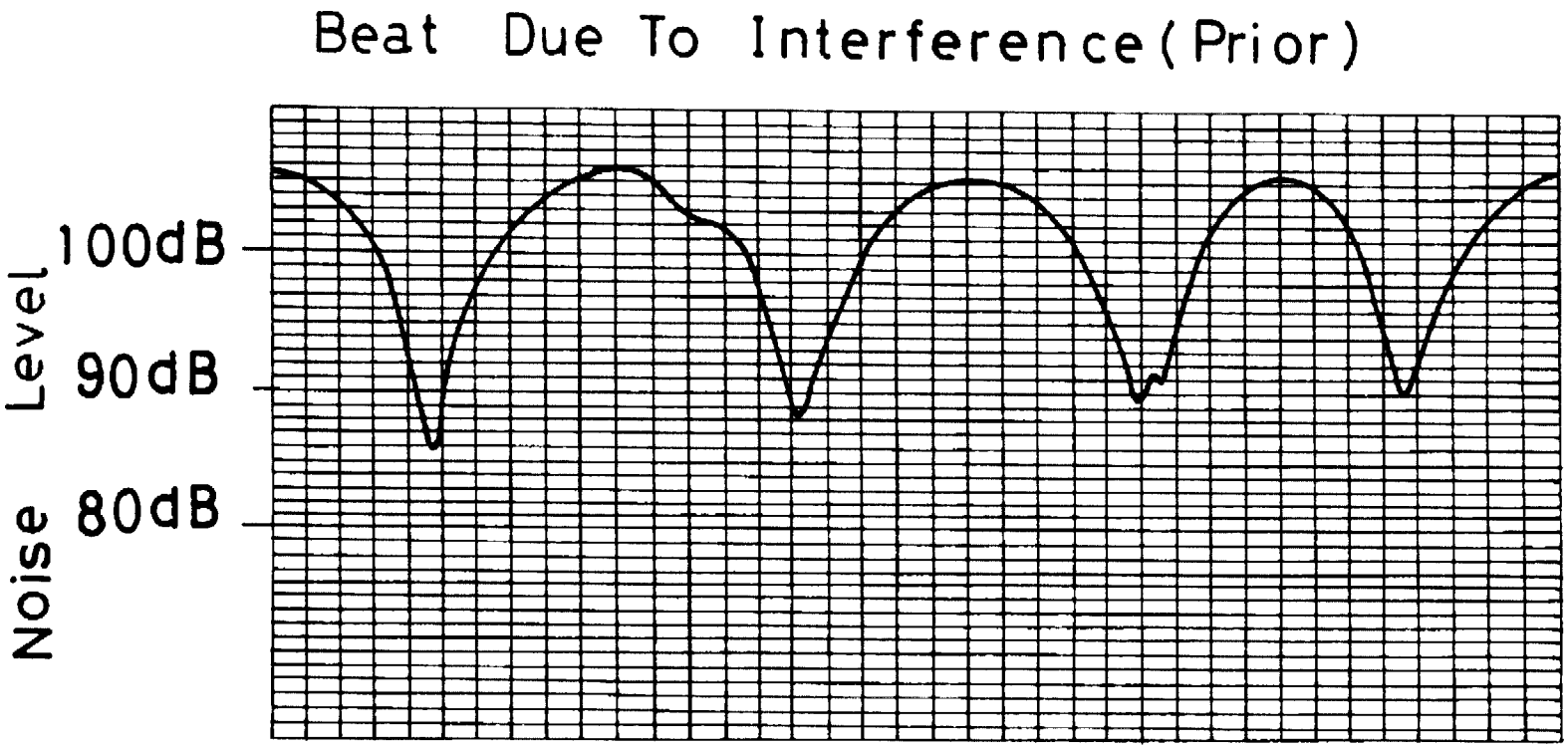
FIG. 22 is a graph for explaining beating phenomenon of the vibratory drum machine of FIG. 21.

When both of the vibratory drum machines 1A, 1B are driven, a beating phenomenon occurs in the houses near the vibratory drum machines 1A, 1B. The houses or doors and windows rattle. A public nuisance occurs. The experimental result on the beating phenomenon is shown in FIG. 22. There is some slight difference between the frequencys of the exciters 3A, 3B. The sounds interfere with each other so that the beating phenomenon occurs. As shown in FIG. 22, the beat occurs about between the sound levels 80 dB and 100 dB. Thus, the houses near the vibratory drum machine apparatus vibrate or rattle. That is a public nuisance.

Figure 19:
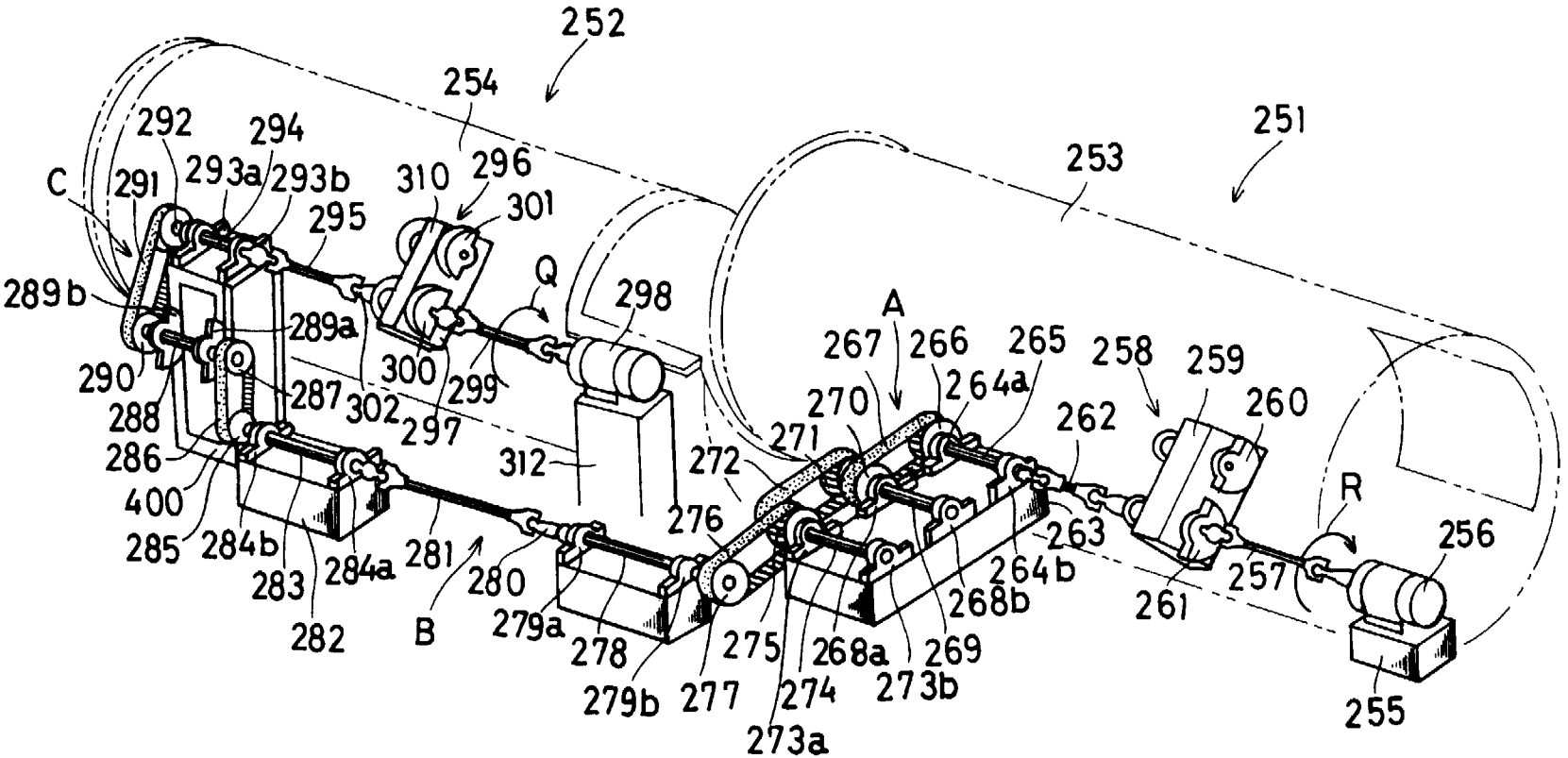
FIG. 19 is a schematic perspective view of a vibratory drum machine according to a sixth embodiment of this invention.

FIG. 19 shows a vibratory drum machine according to the sixth embodiment of this invention, to remove the above described disadvantages.

In FIG. 19, a first vibratory drum machine member 251 and a second vibratory drum machine member 252 are arranged in serial with each other and adjacent to each other. A first vibratory drum body 253 and a second vibratory drum body 254 have the same construction as above described embodiment. An induction motor 256 is arranged on a mounting frame 255 which is fixed on the earth in the first vibratory drum machine member 251. A rotary shaft of the induction motor 256 is connected through a flexible shaft 257 to a first exciter 258. The first exciter 258 includes a casing 259 which is fixed on the drum body 253 of the first vibratory drum 251 at the angular portion of 25° as in the second embodiment. The casing 259 contains gears engaged with each other and bearings for supporting rotary shafts. Substantially, sem-circular unbalance weights 261 are fixed to both ends of one of rotary shafts supported by the one bearing. The one rotary shaft is connected to the above flexible shaft 257. Unbalance weights 260 having the same shape as the above unbalance weights 261 are fixed to both ends of the other rotary shaft in the casing 259. The unbalance weights 260 and 261 are rotated at the same speed in the opposite directions with gears engaged with each other.

The one rotary shaft to which the unbalance weight 261 is fixed, is projecting outwards from the casing 259. It is connected through a flexible shaft 262 to a first synchronizing apparatus A.

The first synchronizing apparatus A is arranged on a frame 263 which is fixed on the earth. The above described flexible shaft 262 is connected to one end of a rotary shaft 265 which is supported by a pair of bearing housings 264*a* and 264*b* at both ends. A gear 266 on which splines are formed, is fixed to another end of the rotary shaft 265. A rotary shaft 269 is supported by a pair of bearing housings 268*a* and 268*b* at both ends. A gear 275 on which splines are formed, is fixed to one end of the rotary shaft 269. A timing belt 267 is wound around the above described gears 266 and 270. Splines are formed on the inside surface of the timing belt 267, and they are engaged with the dears 266 and 270.

Another gear 271 is fixed to one end of the rotary shaft 269. A rotary shaft 274 is supported by bearing housings 273*a* and 273*b* at both ends. A gear 275 is fixed to one end of the rotary shaft 274. A timing belt 272 is wound around the gears 271 and 275. Further, the gear 275 is fixed to one end of a third rotary shaft 274. In the above described manner, the first synchronizing apparatus A is constituted.

Next, a second synchronizing apparatus B will be described.

A pair of bearing housings 279 and 279*b* is fixed on a mounting frame which is fixed on the earth. A rotary shaft 278 is rotatably supported by the bearings 279*a*, 279*b* at both ends. A gear 277 is fixed to one end of the rotary shaft 278. A timing belt 276 is wound around the gear 277 and the gear 275 which is an end transmitting factor of the first synchronizing apparatus A. Another end of the rotary shaft 278 is connected through a flexible shaft 281 to a second rotary shaft 283 which is supported by bearings 284*a*, 284*b* at both ends. The bearings 284*a*, 284*b* are supported on a mounting frame 282 which is fixed on the earth.

Next, a third synchronizing apparatus C will be described. A pair of bearing housings 289*a*, 289*b* is fixed on a side wall portion of a relatively high mounting frame 400. A rotary shaft 288 is fixed by the bearing housing 289*a* and 289*b* at both ends. A gear 287 is fixed to one end of the rotary shaft 288. A timing belt 286 is wound around the gear 287 and the gear 285 which is a last transmitting factor of the second synchronizing apparatus B. A gear 290 is fixed to another end of the rotary shaft 288. A rotary shaft 294 is rotatably supported by a pair of bearing housings 293*a* and 293*b* which are mounted on the frame 400. A gear 292 is fixed to one end of the rotary shaft 294. A timing belt 291 is wound around the gears 290 and 292.

The third synchronizing apparatus C is so constructed as above described. Another end of the rotary shaft 94 which is a last transmitting factor of the third synchronizing apparatus C, is connected through a flexible shaft 295 to a second exciter 296.

The second exciter 296 is so constructed as the first exciter 258 and it is mounted on the drum body 254 at the same anguler position as the first exciter 258. A casing 310 contains bearings and gears engaged with each other. One of the rotary shafts is connected to the above flexible shaft 295. Substantially semi-circular unbalance weights 300 are fixed to the rotary shaft. One end of the rotary shaft is connected through a flexible shaft 299 to a rotary shaft of an induction motor 298. Unbalance weights 301 are fixed on another rotary shaft. The unbalance weights 300 and 301 are rotated at the same speed in the opposite directions. The induction motor 298 is mounted on a high mounting frame 312 which is fixed on the earth.

There will be described the operations of the above described vibratory drum machine consisting of the first vibrating drum machine member 251 and second vibrating drum machine member 252. The induction motors 256 and 298 are connected to the same commercial supply source. When the power source is connected, the first exciter 258 is driven through the flexible shaft 257. The pair of the unbalance weights 260 and 261 are rotated in the opposite directions at the same speed. As well-known, a linear vibratory force is generated in a direction perpendicularly to the line connecting the central lines of the rotary shafts. It is applied to the peripheral wall of the drum body 253. As in the above described embodiment, for example, cast emponents and sands are stirred and circulated in the drum body 253. It is assumed that the rotational direction of the induction motor 256 is in the arrow shown by R. Thus, the rotary shaft is rotated in the clockwise direction in view of the back of the induction motor 256. The rotational force in this direction is transmitted through the flexible shaft 262, the first synchronizing apparatus A, second synchronizing apparatus B and third synchronizing, apparatus C to the flexible shaft 295 of the second exciter 296 in the same direction.

Figure 20:
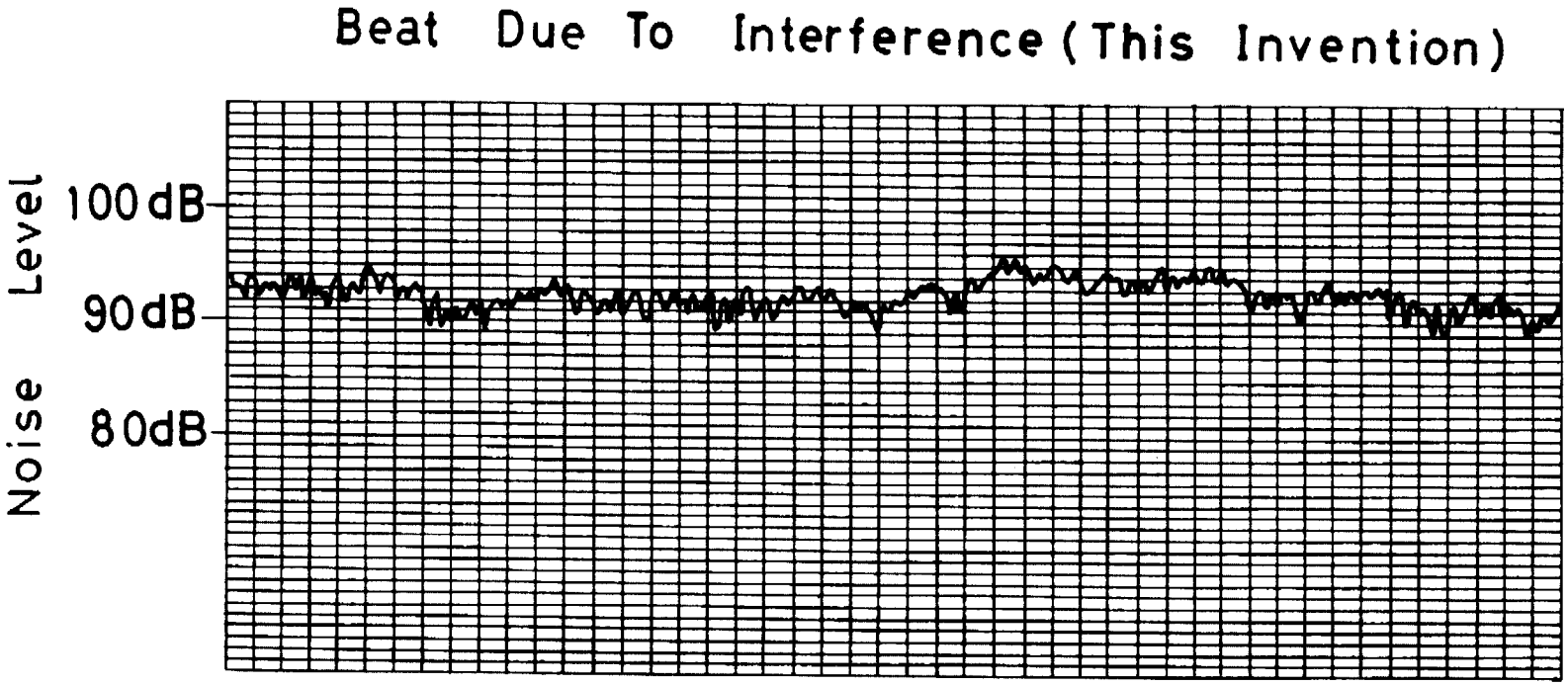
FIG. 20 is a graph for explaining effects of the sixth embodiment with respect to the beating phenomenon.

The rotary shaft of the other induction motor 298 is driven in the direction shown by a arrow Q. The rotational direction R of the first induction motor 256 is in the same as the direction of the other induction motor 298. The induction motors 256 and 298 are of 4 poles type. The commercial supply source is of 50 Hz. The induction motors 256, 298 slip in accordance with loads applied to the rotary shafts. For example, both of the induction motors 256, 298 are rotated at 1450 R.P.M. in the synchronizing condition. The similar effects to those of the above described embodiment are imparted to the first and second vibratory .drum bodies 253 and 254. According to this embodiment, the first exciter 258 and second exciter 296 are synchronized with each other and so generate linear vibratory forces at the same frequency. The noise level of the vibratory drum machine is shown in FIG. 20. It is clear from FIG. 20 that beating phenomenon is much decreased.

In the above sixth embodiment, the exciters 258 and 296 generate the linear vibrating forces. Accordingly, they include the gears. According to this invention, the exciters should generate circular or elliptic vibrational forces. Therefore, the exciters should be so constructed as in any one of the above first to fifth embodiments. No gears are required. Of course, the exciters should be driven through the synchronizing apparatus as shown in FIG. 19 for preventing the beating phenomenon.

Figure 23:
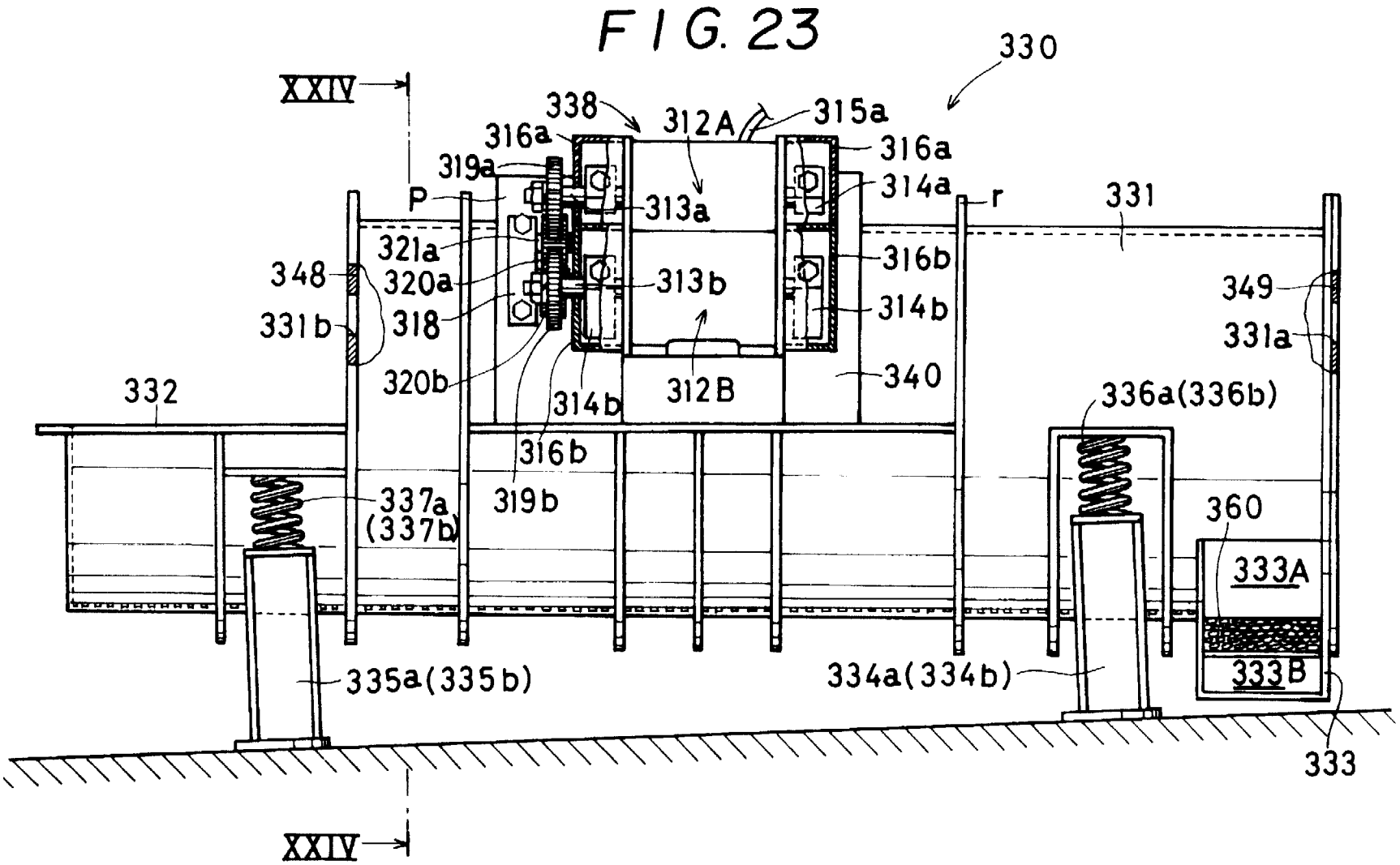
FIG. 23 is a side view of a vibratory drum machine according to a seventh embodiment of this invention.

FIG. 23 shows a vibratory drum machine according to a seventh embodiment of this invention. In FIG. 23, the vibratory drum machine is designated generally by a reference numeral 330. An exciter source 338 is arranged at the side of the peripheral wall of the drum body 331. The drum body 331 is supported through support members 334*a*, 334*b*, 335*a*, 335*b* by coil springs 336*a*, 336*b*, 337*a*, 337*b* on the earth and it is so arranged as to be inclined downwards to the right side by a few degrees. An inlet 332 through which cast components to be cooled and cleaned are supplied, is formed at the left end portion of the drum body 331. An outlet 333 through which the cooled and cleaned cast components and sands are discharged, is formed at the right end portion of the drum body 331. A punch metal plate 360 is extended in the downward region of the internal space of the drum body 331. The sands S separated from the cast components are fallen through the punch metal plate 360 to the lower space 333B. And it is discharged outwards from the down side of the punch metal plate 360. On the other hand, the cast components are discharged from the upper space 333A above the punch metal plate 360. The peripheral, wall of the drum body 331 is strengthened by ribs r. The right opening of the drum body 331 is covered with a cover member 349.

Figure 24:
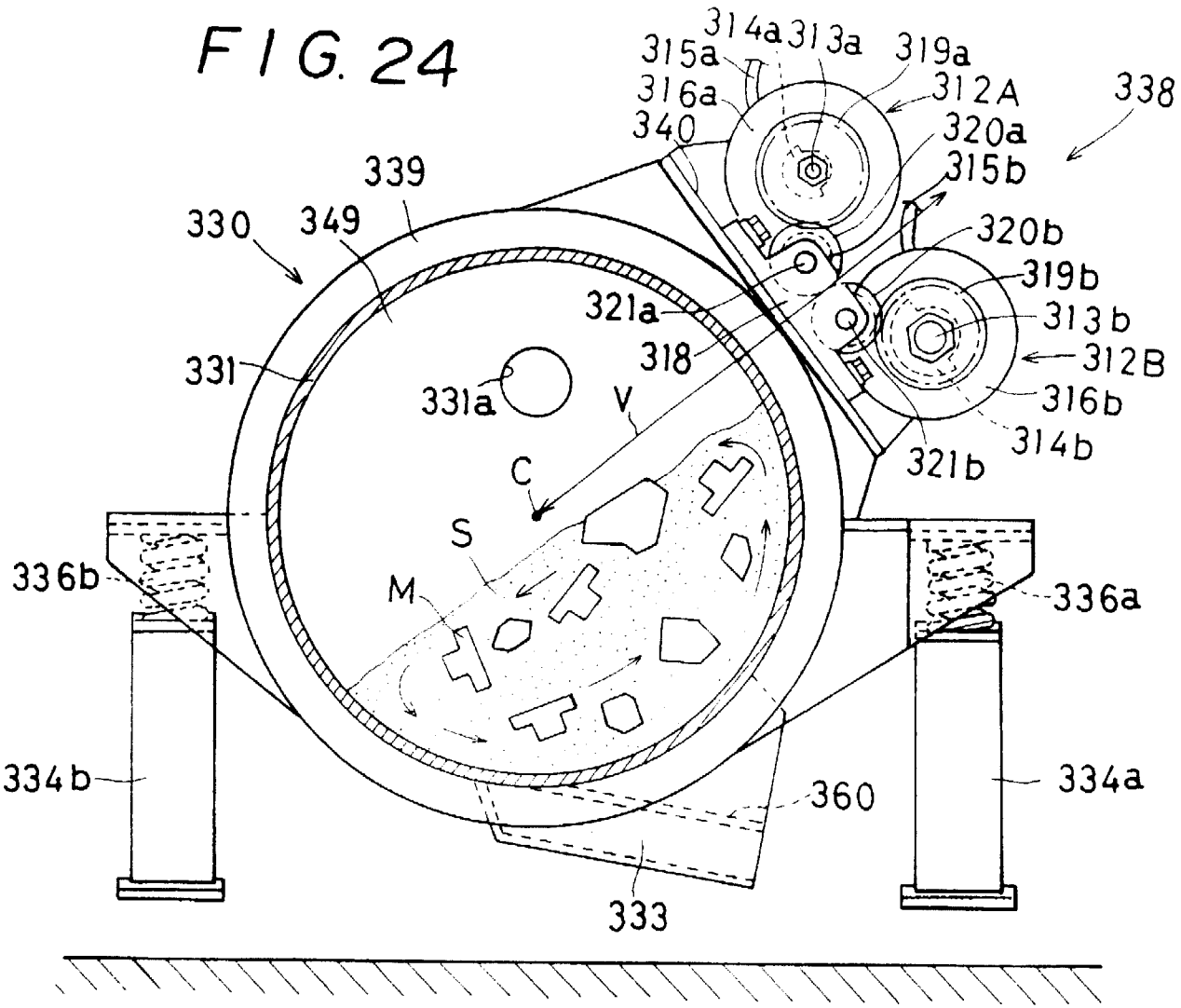
FIG. 24 is a cross-sectional view taken along the line XXIV—XXIV in FIG. 23.
Figure 25:
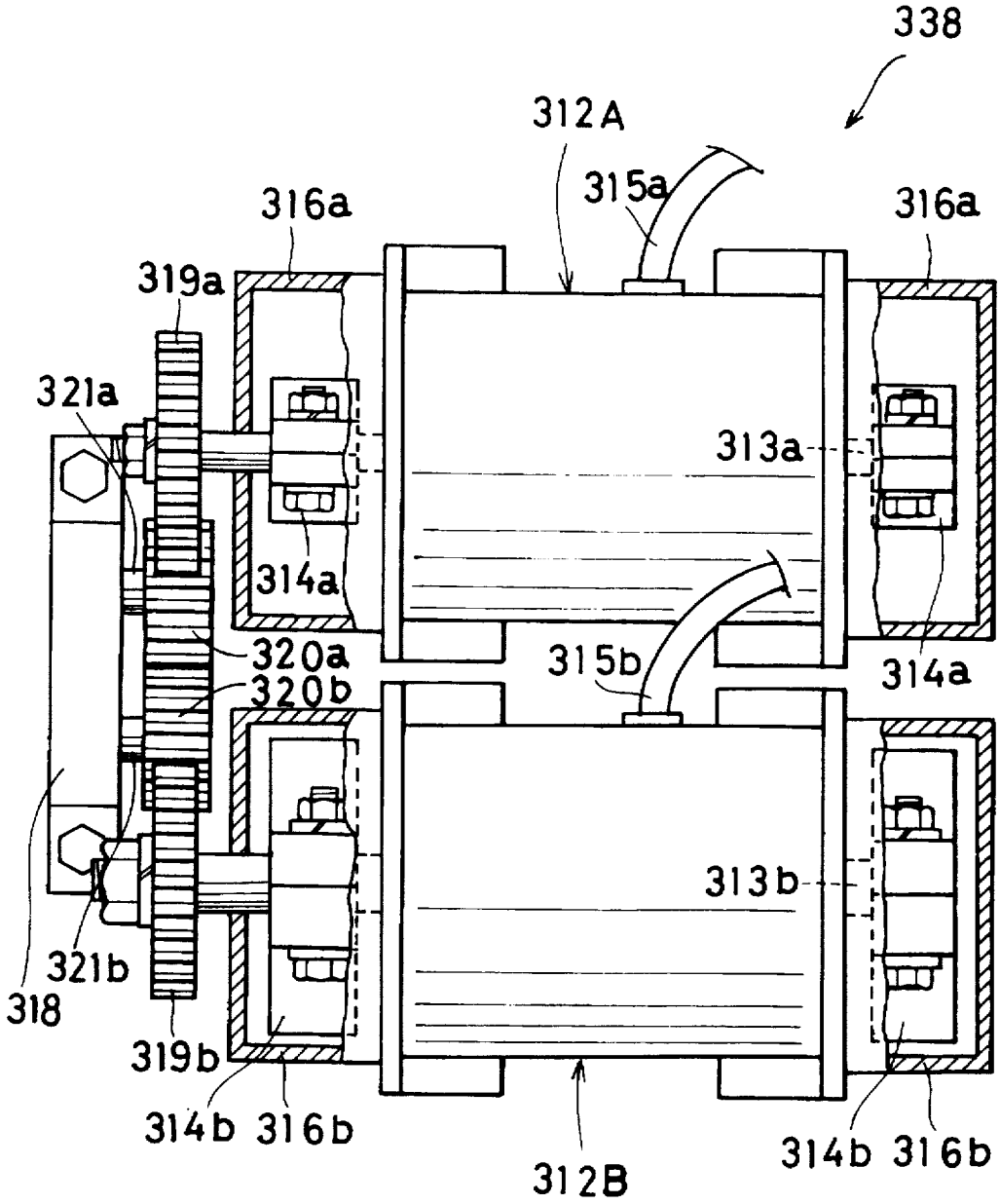
FIG. 25 is a partly-broken enlarged plan view of a vibratory exciter in FIG. 23.
Figure 26:
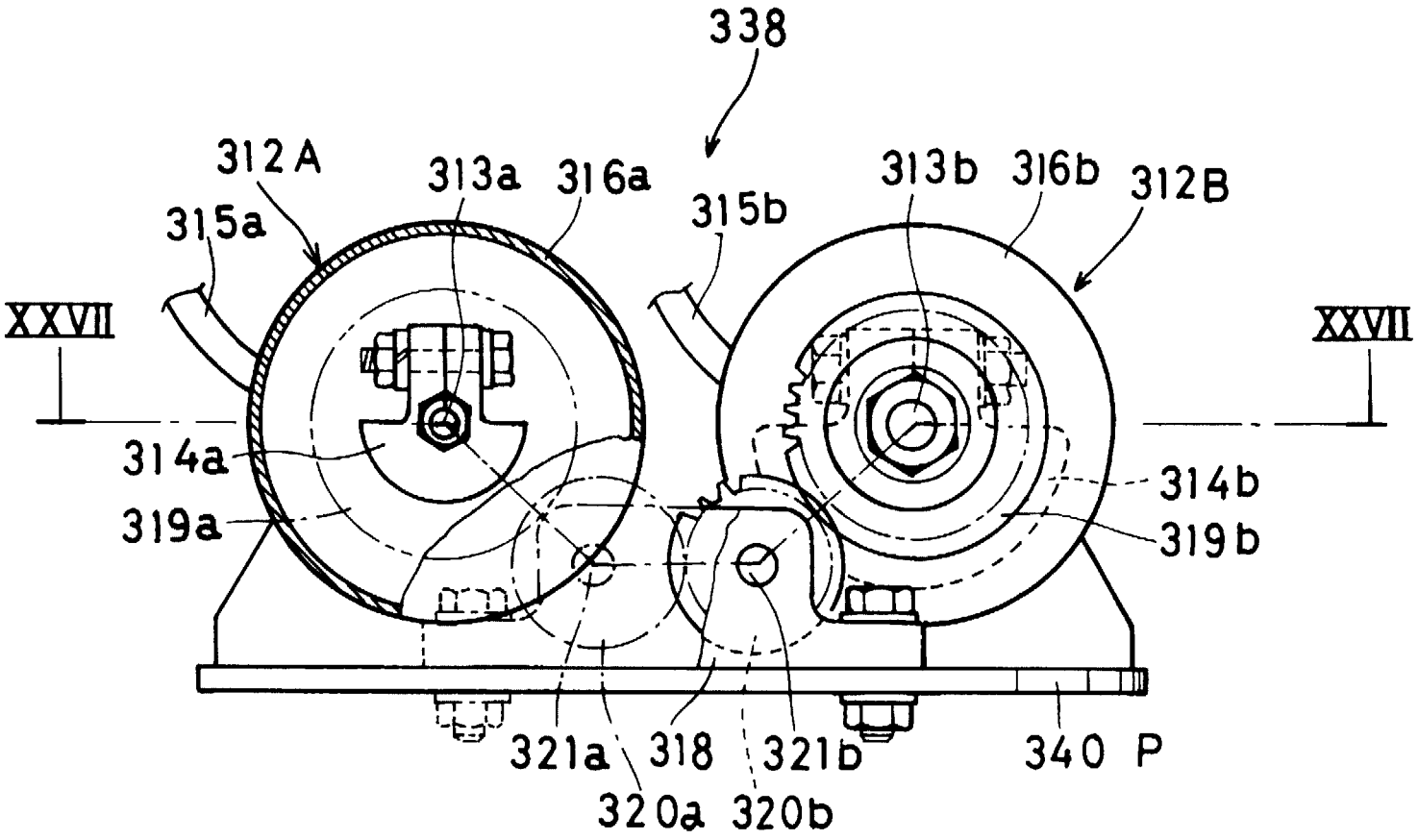
FIG. 26 is a partly-broken front view of the vibratory exciter of FIG. 25.
Figure 27:
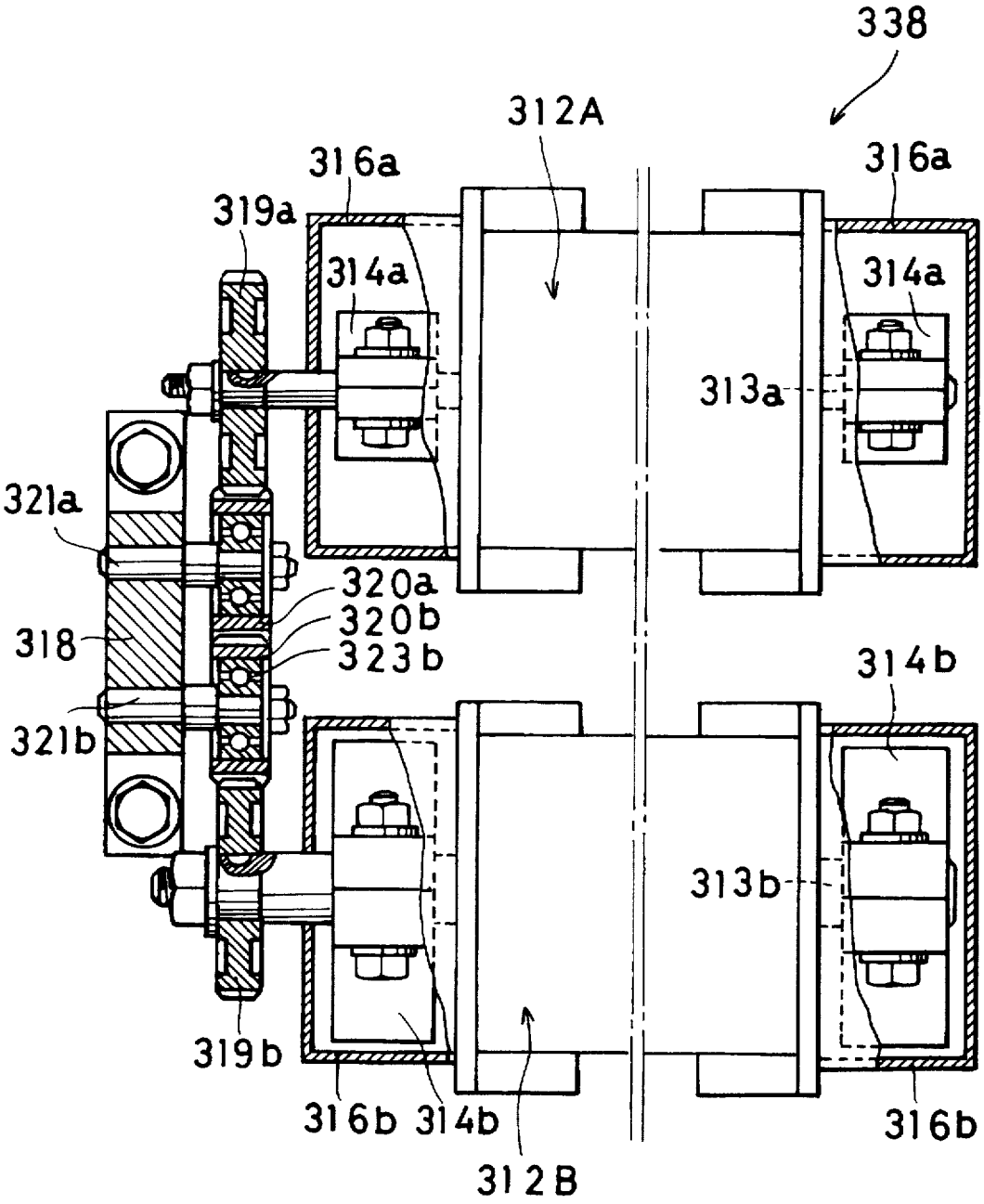
FIG. 27 is a cross-sectional view taken along the line XXVII— XXVII in FIG. 26.
Figure 28:
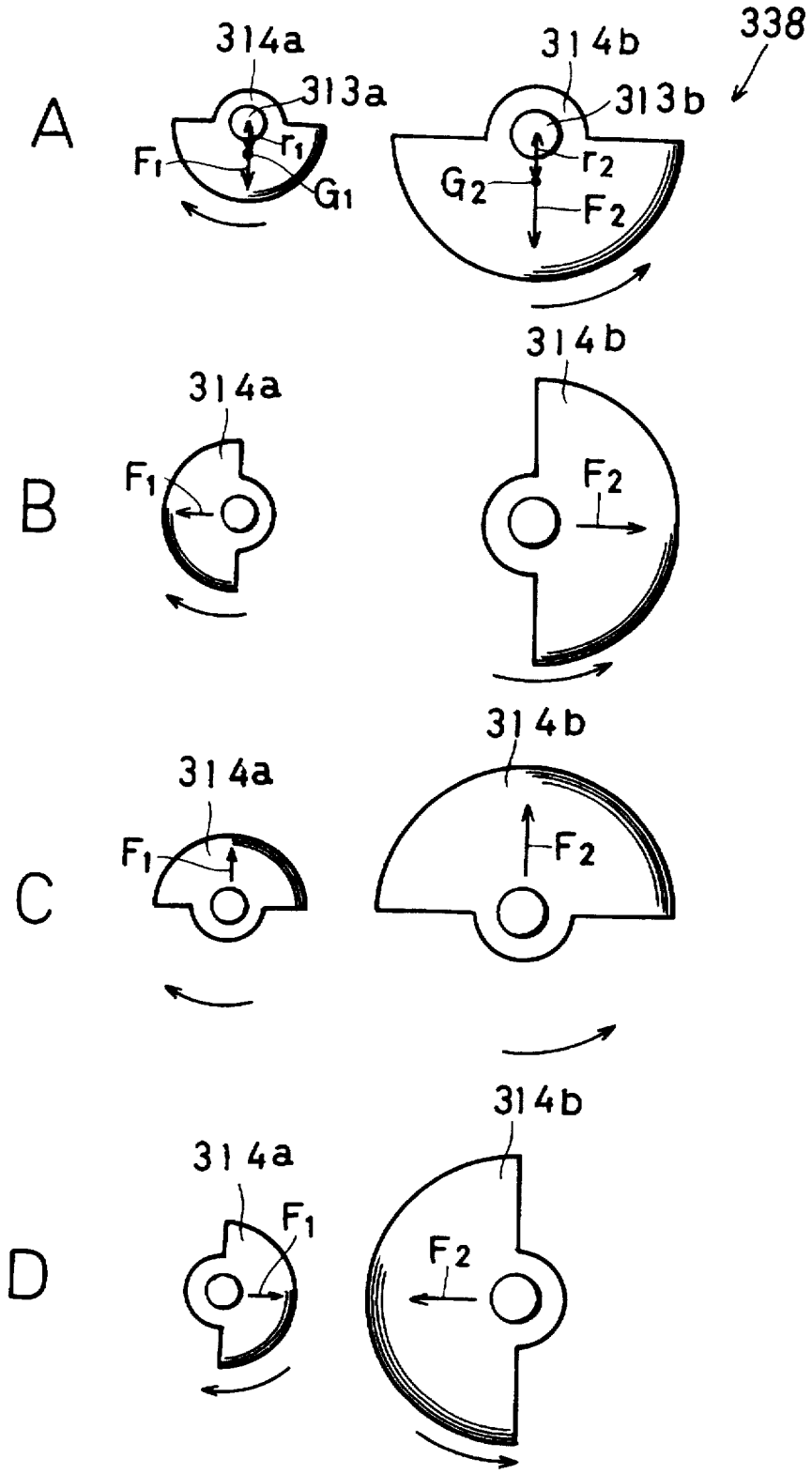
FIG. 28 A to D is a front view of unbalance weights in FIG. 27.

Next, there will be described the details of the exciter source 338 with reference to FIG. 25 to FIG. 28. It consists of a pair of vibratory electric motors 312A and 312B. Smaller and larger unbalance weights 314*a*, 314*a*, 314*b*, 314*b* are fixed to both ends of rotary shafts 313*a*, 313*b* of the vibratory electric motors 312A and 312B. Gears 319*a*, and 319*b* having the same number of the teeth and the same diameter are fixed to the one end portions of the rotary shafts 313a and 313b. Gears 320a and 320b having the same number of teeth and smaller diameter than the gears 319a, 319b are engaged with the gears 319a and 319b at the inner side. The gears 319a and 319b are supported through axes 321a and 321b by bearings 323a, 323b. Teeth as gears 320a and 320b are formed on the outer race sides of the bearings 323a and 323b. The axes 321a, 321b are securely fitted into the inner races of the bearings 323a, 323b and they are supported by bearing members 318 as clearly shown in FIG. 27. Electric power source cords 315a and 315b are led out from the vibratory electric motors 312A, 312B and they are connected to a not-shown commercial power supply source. The unbalance weights 314a, 314a, 314b, 314b are covered with cover members 316a, 316a, 316b, 316b. The rotary shafts 313a, 313b are rotatably inserted through the cover members 316a, 316b. The wall of the exciter source 338 as above described is fixed onto a mounting plate 340. It is fixed on the ribs r fixed to the peripheral wall of the drum body 331. The unbalance weights 314a, 314b according to this embodiment have the shapes as shown in FIG. 28A. "$m_1 \times r_1$" of the smaller unbalance weight 314a is smaller than "$m_2 \times r_2$" of the second unbalance weight 314b. "$r_1$, $r_2$" represent the distances between the central axes of the rotary shafts 313a, 313b and the gravitational centers $G_1$, $G_2$ of the unbalance weights 314a, 314b respectively. "$m_1$ and $m_2$" represent the masses of the unbalance weights 314a, 314b respectively. The unbalance weights 314a, 314b fixed to the rotary shaft 313a, 313b are rotated in the opposite directions at the same speed. The centrifugal force $F_1$ generated by the rotation of the unbalance weight 314a is equal to $m_1 \times r_1 \times \omega^2$ where $\omega$ represents an angular speed, while another centrifugal force $F_2$ is generated by the rotation of the unbalance weight 314b. It is equal to $m_2 \times r_2 \times \omega^2$. It is clear that the centrifugal force $F_1$ is smaller than the other centrifugal force $F_2$. The angle of the line V in FIG. 24 make an angle of 45 degrees with the horizontal line.

There will be described the operations of the above described vibratory drum machine 330.

First, operations of the exciter source 38 will be described. The unbalance weights 314a, 314b are rotated in respective rotary phases as shown in FIG. 28. The lines connecting the gravitational center $G_1$, $G_2$ with the central axis of the rotary shafts 313a and 313b are directed downwards as shown in FIG. 28A. Accordingly, the centrifugal forces $F_1$, $F_2$ generated by the rotation of the unbalance weights 314a and 314b are directed downwards. The unbalance weights 314a, 314b are rotated at the same angular speed $\omega$. When the unbalance weights 314a, 314b are rotated by the angle of 90 degrees from the rotary phase of FIG. 28A, the unbalance weights 314a, 314b take the rotary phases as shown in FIG. 28B. In this rotary phase, the centrifugal forces $F_1$, $F_2$ generated by the unbalance weights 314a, 314b are directed horizontal and opposite to each other. When the unbalance weights 314a, 314b are rotated by the angle of 90 degrees from the rotary phase of FIG. 28B, the unbalance weights 314a, 314b take the rotary phase as shown in FIG. 28C. In this rotary phase, the centrifugal forces $F_1$, $F_2$ are directed upwards. When the unbalance weights 314a, 314b are rotated further by the angle of 90 degrees from the rotary phase of FIG. 28C, the unbalance weights 314a, 314b take the rotary phase as shown in FIG. 28D. In this rotary phase, the centrifugal forces $F_1$, $F_2$ are directed horizontally and opposite to each other. The resultant of the centrifugal forces $F_1$ and $F_2$ of the unbalance weights 314a, 314b in the rotary phase shown in FIG. 28A is equal to $(F_1+F_2)$ in the downward vertical direction. In the rotary phase of FIG. 28B, the resultant of the centrifugal forces $F_1$, $F_2$ of the unbalance weights 314a, 314b is equal to $(F_1—F_1)$ in the horizontal direction and is equal to "0" in the vertical direction. In the rotary phase of FIG. 28C, the resultant of the centrifugal forces $F_1$, $F_2$ of the unbalance weights 314a, 314b is equal to $(F_2+F_1)$ in the upward vertical direction and is equal to "0" in the horizontal direction. And in the rotary phase of FIG. 28D, the resultant of the centrifugal forces $F_1$, $F_2$ of unbalance weights 314a, 314b is equal to "0" in the vertical direction and is equal to $(F_2-F_1)$ in the horizontal direction. However, it is opposite to the direction in the rotary phase of FIG. 28B.

It is clear from the above description that an elliptic vibrational force is generated for a movable body.

Figure 29:
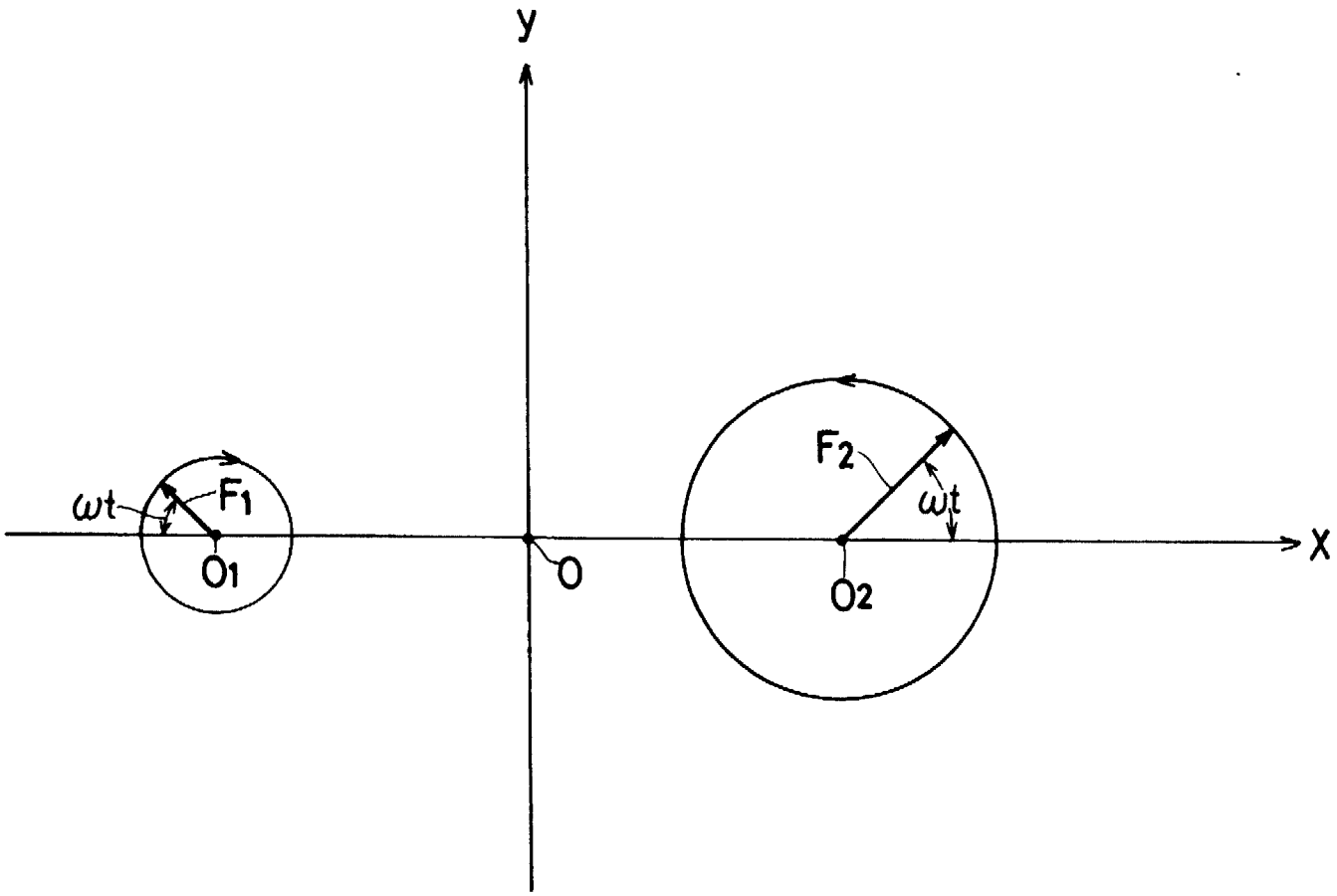
FIG. 29 is a schematic view for explaining operations of the seventh embodiment of this invention.

Next, the above fact will be proved mathematically. The mounting point of the exciter 338 to the movable body in FIG. 29 is represented by "0" in right (rectangular) coordinate X axis and abscissa Y axis, and it is taken as the original point "0". Points "$0_1$" and "$0_2$" are taken at the same distance from the original point "0" and in the opposite directions. The points "$0_1$" and "$0_2$" are equal to the central axes of the rotary shafts 313a and 313b of the vibratory electic motors 312A and 312B. The rotary shafts 313a and 313b are rotated at the same speed in the opposite directions. The angular velocity is equal to $\omega$. When the centrifugal forces $F_1$ and $F_2$ of the unbalance weights 314a, 314b aligns on the axis X in the opposite directions, when a start point of the time is chosen at the rotary phase of FIG. 28B. After time t seconds, the unbalance weights take the position as shown in FIG. 29. The centrifugal forces $F_1$, $F_2$ are directed in the directions as shown in FIG. 29.

Force components in the Y axis and the X axis are as follows: $Y= F_1 \sin \omega t+F_2 \sin \omega t=(F_1+ F_2) \sin \omega t$, $x=F_1 \cos \omega t-F_2 \cos\omega t=(F_1-F_2) \cos \omega t$. When the $(F_1+F_2)$ is substituted with A and $(F_1-F_2)$ is substituted with B, y and x can be represented by the following equations: $y=A \sin \omega t$, $x= B \cos \omega t$. From these equations, $y^2= A^2(1-\cos \omega t^2)$, further $1=y^2/A^2+x^2/B^2$. Thus, the above equation is that of the ellipse. As above described, it can be proved that the elliptic vibratory force can be generated by the exciter source 338 as shown in FIG. 25 to 28.

When the power supply source cords 315a, 315b are connected to the commercial power source, the rotary shafts 313a and 313b of the vibratory electric motors 312A and 312B are rotated. The gears 319a, 319b and the smaller gears 321a, 321b engaged with the gears 319a and 319b are rotated. The unbalance weight 314a, 314a, 314b, 314b of the vibratory electric motor 312A, 312B are rotated at the same speed in synchronization with each other, in the opposite directions with engagement of the gears 319a, 319b and 321a, 321b. Thus, the unbalance weights 314a, 314a, 314b, 314b are driven in forcible synchronization with each other.

In the manner as above described, the elliptic vibratory force is generated and it is transmitted to the drum body 331. Accordingly, the drum body 331 is vibrated in the intermediate mode between the mode shown in FIG. 5 and the other mode shown in FIG. 10. The cast components M in the drum body 331 are circulated as shown by the arrow in the above embodiments. The sands S are separated from the cast components M with a vibrational force. The cast components M are moved rightwards (in FIG. 23) receiving the above separating operation and the sands separated through the punch metal plate 60 from the cast components M are discharged outwards from the lower space 333B at the outlet 333. The cast components M from which the sands S is separated, are discharged outwards from the upper space 333A.

According to this embodiment, the vibratory electric motors 312A, 312B are driven in forcible synchronization with the gears 319*a*, 319*b*, 320*a* and 320*b*. As above described in FIG. 24, the vibratory electric motors 312A and 312B are arranged at the position distant from the gravity center of the whole vibratory drum machine 330. However, they can be securely driven in synchronization and so the elliptic vibrational force can be stably transmitted to the drum body 331. Accordingly, the sands can be stably separated from the cast components. The vibratory drum machine 330 of this embodiment has the same effect as the above embodiments. As shown in the above embodiment FIG. 23, the sands S and cast components M are circulated and so the sands can be securely separated from the cast components. Further, in the above described embodiment the circulating speed of the cast components M and that of the sands S are different from each other, and so the sands can be prevented from being aged. Further, the cast components can be protected by the sands S and it can be prevented from being damaged with collision onto the peripheral wall of the drum body 331. These effects can be obtained also in the above embodiment. Further, the pair of the vibratory electric motors 312A, 312B is combined merely with the gears to synchronize forcibly with each other and they are fixed directly onto the drum body 331. That is a simple construction in contrast to the prior art vibratory drum machine. Accordingly the cost can be remarkably reduced.

Figure 30:
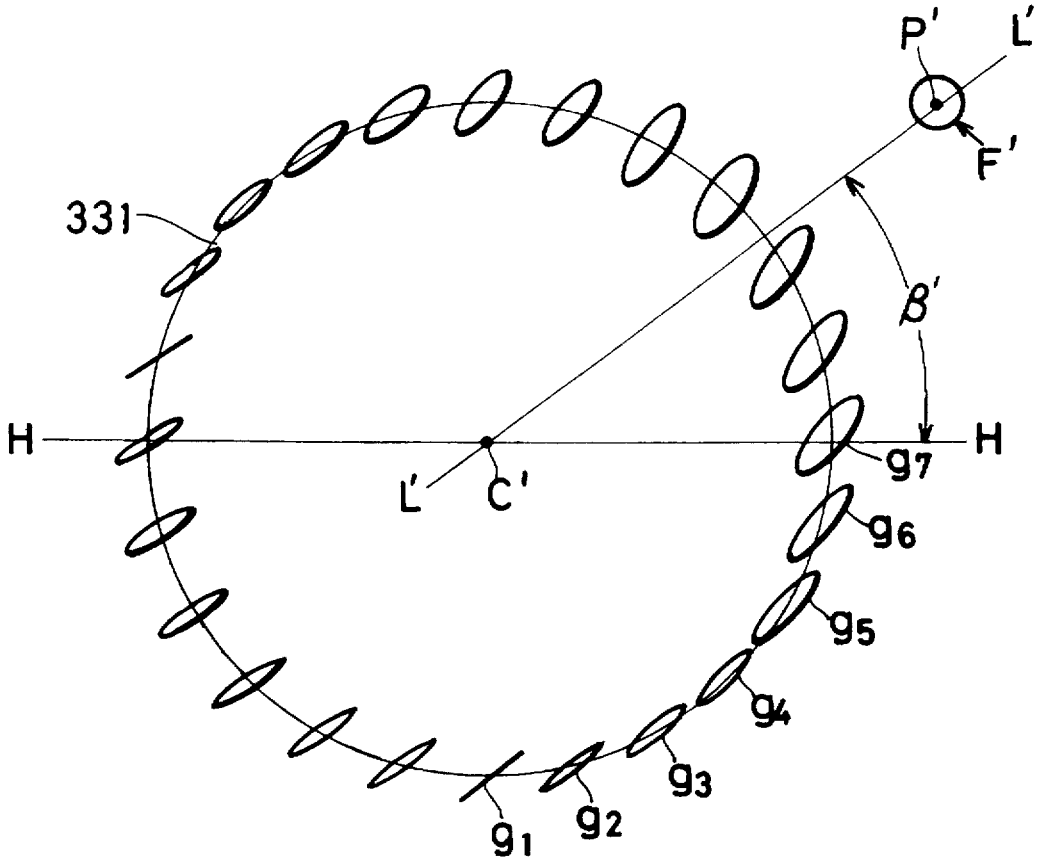
FIG. 30 is a cross-sectional schematic view of the seventh embodiment of this invention for explaining the effects.

According to this embodiment, the exciter 338 generating the above described elliptic vibrational force is mounted on the peripheral wall of the vibratory drum body 331. The drum body 331 is inferred to be vibrated in the intermediate mode between the mode (FIG. 5) of the other prior art vibratory drum machine and the other mode of the vibratory drum machine 41A shown in FIG. 10. Thus, the amplitude of the long axis and that of the short axis are different from each other in the elliptical vibrational force. The force component of the long axis generates the vibration mode almost equal to the vibration mode shown in FIG. 5, and the direction of the long axis of the elliptical vibration is made the vibrational direction V. The vibration of the short axis imparts the vibration component in the vertical direction relative to the line L of the above circular vibrational force. In the above described elliptic vibrational force, the direction of the long axis is almost parallel relative to the line L'—L' in FIG. 30 and the vibration component of the short axis is almost vertical to the line L'—L'. The elliptic vibrational mode as shown in FIG. 30 can be obtained. The stirring operation can be obtained with the vibrational mode as shown in FIG. 30. The cast components and sands can be more effectively stirred and cooled in comparison with the prior art vibratory drum machine. The sand can be more effectively separated from the cast components. The ratio of the long axis of the elliptic vibrational force to the component of the short axis thereof can be adjusted in accordance with MR ("mass"×"the center of the rotation"–the gravity center/distance) of the first and second unbalance weights. For example, when MR of the first unbalance weight is made larger than that of the second unbalance weight, the amplitude of the short axis of the elliptic vibration can be larger.

FIG. 30 shows the result of the calculation by the electronic computer to obtain the vibration mode of this invention. The dimensions of the drum body are somewhat different from the case of the above embodiment in FIG. 6. The mounting angle β' of the exciter source F' relative to the drum body is different from that of the above embodiment. However, the vibration mode as expected can be obtained.

In the region adjacent to the most lower wall portion of the drum body 331, almost linear vibrations as shown by $g_1$, $g_2$, $g_3$ can be obtained. They have the angle of about 45 degrees which imparts the foward movement force to the cast component. In the region between the angles of 45 degrees and 75 degrees in the counterclockwise direction, the vibration modes as shown by $g_4$, $g_5$, $g_6$ can be obtained. The short axis of the elliptic vibrations becomes larger and so the vertical components relative to the wall surface of the drum body 331 become larger. Accordingly, the cast components M and sands S can jump in the diameter direction from the wall surface of the drum body 331. Thus, the cast components M and sands S can be effectively stirred and cooled. The sands S can be effectively separated from the cast component M.

Figure 31:
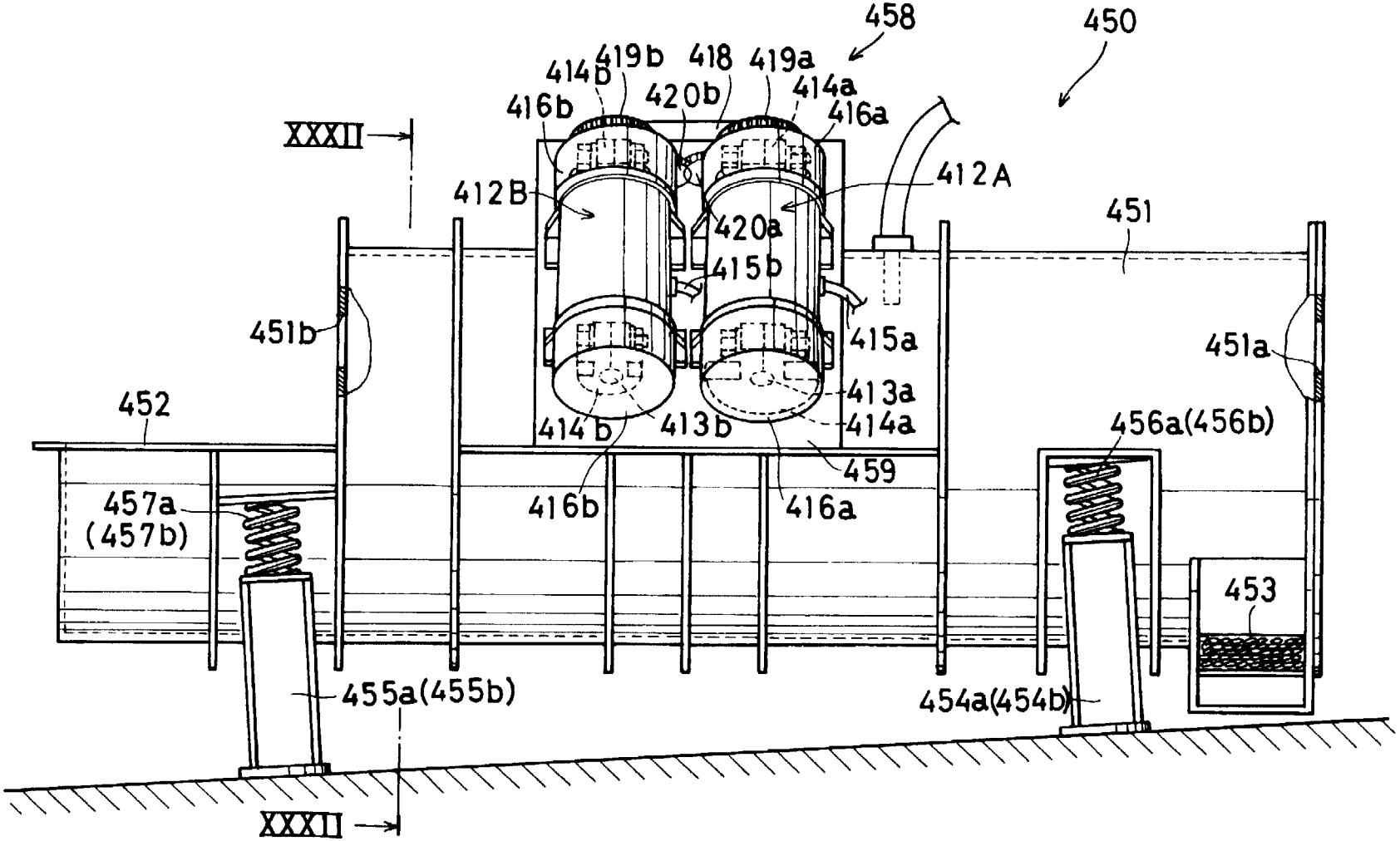
FIG. 31 is a side view of a vibratory drum machine according to an eighth embodiment of this invention.
Figure 32:
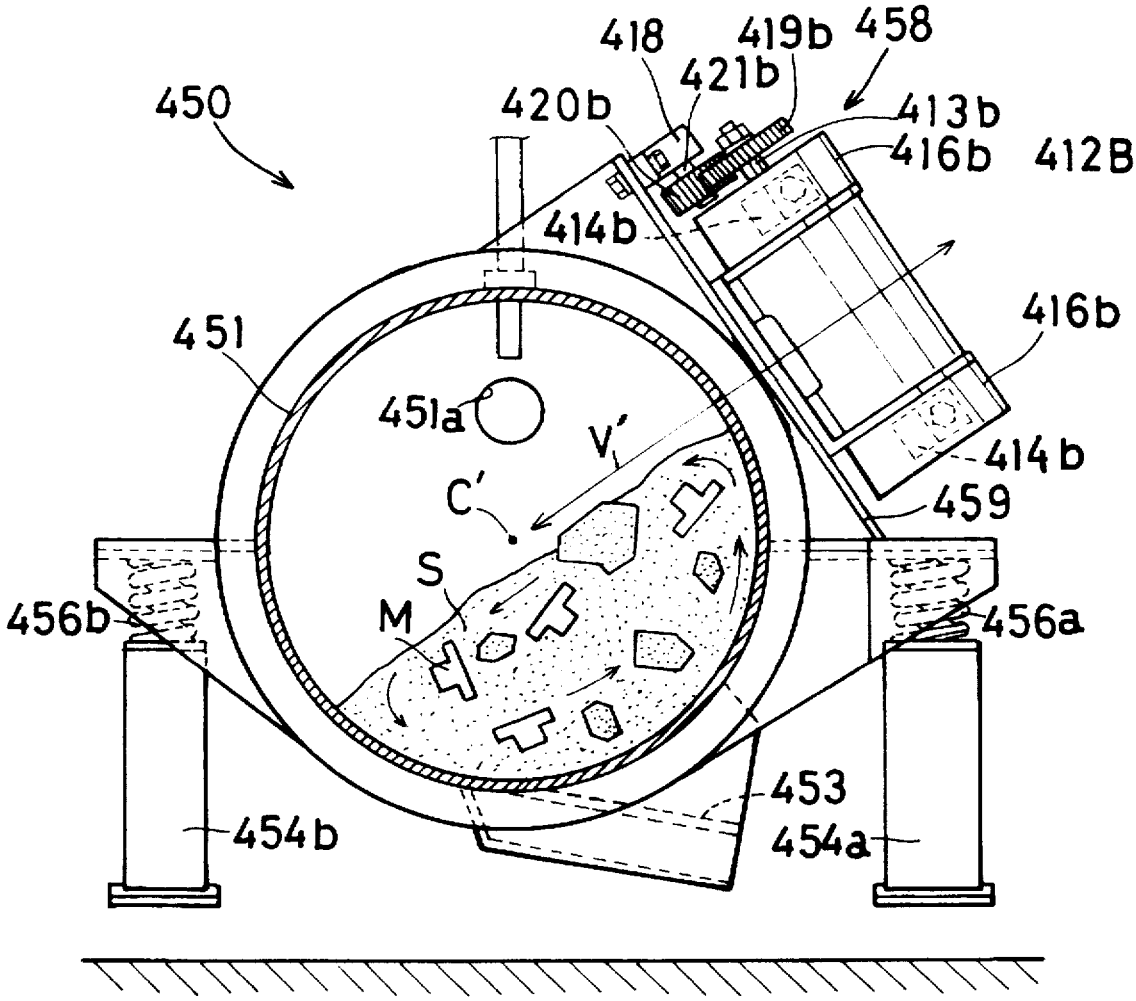
FIG. 32 is a cross-sectional view taken along the line XXXII—XXXII in FIG. 31.

FIG. 31 and FIG. 32 shows a vibratory drum machine according to an eighth embodiment of this invention. Parts in FIG. 31 and 32 which correspond to those in the above embodiment, are denoted by the same reference numerals, the detailed description of which will be omitted.

A vibratory drum machine according to this embodiment is designated generally by a reference numeral 450. The side view of this embodiment is almost equal to that of the above embodiment. An inlet 452 is formed at the one end portion of the drum body 451. An outlet 453 is formed at the other end portion of the drum body 451. The drum body 451 is so supported as to be inclined downwards by a few degrees through coil springs 456*a*, 456*b*, 457*a* and 457*b* by support members 454*a*, 454*b*, 455*a* and 455*b*. An exciter source 458 is mounted at the one side of the drum body 451. It has the same construction as the above described embodiment. However, the rotary shafts 413*a*, 413*b* of the vibratory electric motors 412A, 412B are almost perpendicular to the central axes C' of the drum body 451 in contrast to the seventh embodiment.

A linear (long axis) vibrational force component generated by the vibratory electric motors 412A, 412B pass through the central axis C' of the drum body 451. Accordingly, a larger synchronizing force due to vibration can be imparted to the exciter than the seventh embodiment. Thus, the strength of the gears for forcibly synchronizing the vibratory electric motors 412A, 412B can be smaller. The other operations and effects are the same as those of the above seventh embodiment.

While the preferred embodiment has been described, variations thereto will occur to those skilled in the art within the scope of the present inventive concepts which are delineated by the following claims.

For example, in the embodiment of FIG. 14 the gravity center G of the vibratory drum machine 41C including the exciter lies on the line connecting the center P of the circular force F of the exciter with the central axis C of the drum body 42', or the line connecting the central axis of the links 65 and 71 with the central axis C of the drum body 42'. However, the exciter may be arranged so that the gravity center G is somewhat distant from the line connecting the center P with the center axis C.

Further, in the embodiment of FIG. 10, the angle β which the line connecting the center of the circular vibratory force vertically with the central axis C of the drum body 42 makes with the horizontal line H—H, is equal to 25 degrees. However, it may be larger or smaller than 25 degrees, for example, 30°, 45° or 50°, or 10° or 20°. By such a variation also, the disadvantages of the prior art can be removed. However, the optimum condition can be obtained in the range of the angles γ of 20 to 30 degrees.

Further, in the embodiment of FIG. 16 the three vibratory electric motors $M_1$, $M_2$ and $M_3$ are fixed on the peripheral wall of the cylindrical drum body 42. They have the same capacity and are connected to the common comercial power source.

They may be connected in serial will each other through couplings, so that they can be securely rotated in synchronization with each other.

Further, in the above embodiments, the drum body is inclined downwards towards the outlet at the angle of the few degrees. However, it may be horizontally arranged or upwards towards the outlet at the angle of the few degrees. When the articles to be treated, are sufficiently fluid, the articles supplied through the inlet can sufficiently be treated and discharged through the outlet.

Further, in the embodiment of FIG. 19, the drum bodies 253 and 254 are arranged in serial with each other. However, they may be arranged in parallel with each other.

Further, the timing belts are used in the synchronizing apparatus A, B and C. However, they may comprise only gears engaged with each other.

Further, the unbalance weights 260 and 261, and 300 and 301 are equal to each other in size or m×r, in the respective exciters 258 and 296. However, they may be different from each other in m×r. In that case, elliptical vibrational forces are generated by the exciters 258 and 296.

Further in the embodiments except the embodiment of FIG. 14, the casting components and sands are treated, and in the embodiment of FIG. 14 the pulveriged material M is treated or dried.

However, any other article, material or bulk material may be treated in any one of the above embodiments.

What is claimed is:

1. A vibratory drum machine for treating articles comprising:

A. a cylindrical drum body supported resiliently by springs;

B. means for generating an elliptical vibratory force as a resultant force; and

C. means attaching said generating means directly to the peripheral wall of said cylindrical drum body above the horizontal line passing perpendicularly through the central axis of said cylindrical drum body, said generating means comprising electric motors, a first unbalance weight, a second unbalance weight and gear mechanism for transmitting the rotational forces of said electric motors to said first and second unbalance weights at the same speed in the opposite directions, m×r (mass×distance between a rotational center and gravity center) of said first unbalance weight being smaller than that of said second unbalance weight.

2. A vibratory drum machine for separating sands from cast components comprising:

A. a cylindrical drum body supported resiliently by springs, said cylindrical drum body having a peripheral wall defining an inner cylindrical wall surface, B. means for generating a circular vibratory force as a resultant force; and C. means attaching said generating means directly to the peripheral wall of said cylindrical drum body on or above the horizontal line passing perpendicularly through the central axis of said cylindrical drum body, said cylindrical drum body having further an inlet at its one end portion and an outlet at its other end portion, said cast components being supplied through said inlet into said cylindrical drum body and being discharged through said outlet from said cylindrical drum body, wherein the center of gravity G of said vibratory drum machine is spaced away from the central axis of said cylindrical drum body and the center P of said means for generating a circular vibratory force is located outwardly of said peripheral wall and spaced away from said inner cylindrical wall surface so that elliptical vibrations of said inner cylindrical surface wall are effected in such a manner that directions of the longer axis of the elliptical vibrations change gradually and continuously along said inner cylindrical wall surface and said cast components move upward adjacent said inner cylindrical wall surface to a certain level and then circulate downward along a path spaced inwardly from said inner cylindrical wall surface.

3. A vibratory drum machine according to claim 2, in which said generating means comprises a vibratory electric motor in which unbalance weights are fixed to both ends of a rotary shaft.

4. A vibratory drum machine according to claim 2, in which a line connecting the center P of said means for generating said circular vibratory force with said central axis of the cylindrical drum body makes an angle of 20° to 30° with said horizontal line.

5. A vibratory drum machine according to claim 2 in which said generating means comprises plural vibratory electric motors in which unbalance weights are fixed on both ends of rotary shafts, respectively, said vibratory electric motors being so arranged eccentrically to the side of said inlet with respect to the gravity center of said cylindrical drum body that the amplitudes of the longer and shorter axes of said elliptic vibrations are larger at the inlet portion than at the outlet portion.

6. A vibratory drum machine according to claim 3 in which said vibratory electric motor is so arranged eccentrically to the side of said inlet with respect to the gravity center of said cylindrical drum body that the amplitudes of the longer and shorter axis of said elliptic vibrations are larger at the inlet portion than at the outlet portion.

7. A vibratory drum machine for separating sands from cast components comprising:

A. a cylindrical drum body supported resiliently by springs, said cylindrical drum body having a peripheral wall defining an inner cylindrical wall surface;

B. means for generating an elliptical vibratory force as a resultant force; and

C. means attaching said generating means directly to the peripheral wall of said cylindrical drum body on or above the horizontal line passing perpendicularly through the central axis of said cylindrical drum body, said cylindrical drum body having further an inlet at its one end portion and an outlet at its other end portion, said cast components being supplied through said inlet into said cylindrical drum body and being discharged through said outlet from said cylindrical drum body, wherein the center of gravity G of said vibratory drum machine is spaced from the central axis of said cylindrical drum body and the center P of said means for generating an elliptic vibratory force is located outwardly of said peripheral wall and spaced away from said inner cylindrical wall surface so that elliptical vibrations of said inner cylindrical wall surface are effected in such a manner that directions of the longer axis of the elliptical vibrations change gradually and continuously along said inner cylindrical wall surface and said cast components move upward adjacent said inner cylindrical wall surface to a certain level and then circulate downward along a path spaced inwardly from said inner cylindrical wall surface.

8. A vibratory drum machine according to claim 7, in which said generating means comprises electric motors, a first unbalance weight, a second unbalance weight and gear mechanism for transmitting the rotational forces of said electric motors to said first and second unbalance weights at the same speed in the opposite directions, m×r (mass× distance between a rotational center and gravity center) of said first unbalance weight being smaller than that of said second unbalance weight.

9. A vibratory drum machine according to claim 7, in which a line connecting the center of said elliptical vibratory force with said central axis of the cylindrical drum body makes an angle of 45° with said horizontal line.

10. A vibratory drum machine for separating sands from cast components:

A. a cylindrical drum body supported resiliently by springs; said cylindrical drum body having a peripheral wall defining an inner cylindrical wall surface; and B. a circular vibratory force generating source comprising an electric motor supported on the earth, bearing means supported on the peripheral wall of said cylindrical drum body, support axis means rotatably supported by said bearing means and connected through universal joint means to a drive shaft of said electric motor, and unbalance weight means fixed to said support axis means, said cylindrical drum body having further an inlet at its one end portion and an outlet at its other end portion, said cast components being supplied through said inlet into said cylindrical drum body and being discharged through said outlet from said cylindrical drum body, wherein the center of gravity G of said vibratory drum machine is spaced away from the central axis of said cylindrical drum body and the center P of said means for generating a circular vibratory force is located outwardly of said peripheral wall and spaced away from the said inner cylindrical wall surface so that elliptical vibrations of said inner cylindrical wall surface are effected in such a manner that directions of the longer axis of the elliptical vibrations change gradually and continuously along said inner cylindrical wall surface and said cast components move upward adjacent said inner cylindrical wall surface to a certain level and then circulate downward along a path spaced inwardly from said inner cylindrical wall surface.

11. A vibratory drum machine according to claim 10 in which said unbalance weight means comprises a first unbalance weight means comprising a first unbalance weight and a second unbalance weight, m×r (mass×distance between a rotational center and gravity center) of said first unbalance weight being smaller than that of said second unbalance weight being smaller than that of said second unbalance weight, said first unbalance weight being located at the side of said outlet with respect to the gravity center of said cylindrical drum body and said second unbalance weight being located at the side of said inlet with respect to the gravity center of said cylindrical drum body, said bearing means comprising a first bearing member and a second bearing member, said support axis, said universal joint means comprising a first universal joint member and a second universal joint member, said first universal joint member, said first support axis, said second universal joint member and said second support axis being arranged and connected in alignment with each other, in the order of the direction from said outlet towards said inlet, said first and second support axis being supported rotatably by said first and second bearing members, respectively, and said first and second unbalance weights being fixed to said first and second support axis respectively, so that the amplitudes of the longer and shorter axis of said elliptic vibrations are larger at the inlet portion than at the outlet portion.

12. A vibratory drum machine for separating sands from cast components comprising:

A. a cylindrical drum body supported resiliently by springs;

B. means for generating a circular vibratory force.

C. means for attaching said means for generating directly to the peripheral wall of said cylindrical drum body on or above the horizontal line passing perpendicularly through the central axis of said cylindrical drum, and wherein said means for generating comprises an electric motor supported on the earth, bearing means supported on the peripheral wall of said cylindrical drum body, support axis means rotatably supported by said bearing means and connected through universal joint means to a drive shaft of said electric motor, and unbalance weight means fixed to said support axis means, said cylindrical drum body having further an inlet at its one end portion and has an outlet at its other end portion, said cast components being supplied through said inlet into said cylindrical drum body and being discharged through said outlet from said cylindrical drum body, wherein the center of gravity G of said vibratory drum machine is distant from the axis of said cylindrical drum body and the center P of said means for generating a circular vibratory force is distant from the peripheral wall of said cylindrical drum body, said peripheral wall defining an inner cylindrical wall surface, elliptical vibrations imparted to said inner wall surface being effected in such a manner that directions of the longer axis of the elliptical vibrations change gradually and continuously along said inner cylindrical wall surface and said cast components move upward along said inner cylindrical wall surface to a certain level and then circulate downward along a path spaced inward from said inner cylindrical wall surface.

13. A vibratory drum machine for treating articles comprising:

A. a cylindrical drum body supported resiliently by springs; and

B. a circular vibratory force generating source comprising an electric motor supported on the earth, bearing means supported on the peripheral wall of said cylindrical drum body, support axis means rotatably supported by said bearing means and connected through universal joint means to a drive shaft of said electric motor, and unbalance weight means fixed to said support axis means, and wherein said cylindrical drum body has an inlet at its one end portion and has an outlet at its other end, said articles being supplied through said inlet into said cylindrical drum body and being discharged through said outlet from said cylindrical drum body, and said unbalance weight means comprises a first unbalance weight and a second unbalance weight, m×r (mass×distance between a rotational center and gravity center) of said first unbalance weight being smaller than that of said second unbalance weight, said first outlet with respect to the gravity center of said cylindrical drum body and said second unbalance weight being located at the side of said inlet with respect to the gravity center of said cylindrical drum body, said bearing means comprises a first bearing member and a second bearing member, said support axis means comprises a first support axis and a second support axis, said universal joint means comprises a first universal joint member and a second universal joint member, said first universal joint member, said first support axis, said second universal joint member and said second support axis being arranged and connected in alignment with each other, in the order of the direction from said outlet towards said inlet, said first and second support axis being supported rotatably by said first and second bearing member, respectively, and said first and second unbalance weights being fixed to said first and second support axis, respectively.

14. A vibratory drum machine for separating sands from cast components comprising:

A. a first cylindrical drum body supported resiliently by springs;

B. a second cylindrical drum body arranged adjacent to said first cylindrical drum body and supported resiliently by springs;

C. a first circular or elliptical vibratory force generating source fixed on the peripheral wall of said first cylindrical drum body on or above the horizontal line passing perpendicularly through the central axis of said first cylindrical drum body;

D. a second circular or elliptical vibratory force generating source fixed on the peripheral wall of said second cylindrical drum body on or above the horizontal line passing perpendicularly through the central axis of said second cylindrical drum body, and being synchronized with said first circular or elliptical vibratory force generating source by synchronizing means; and, E. each said cylindrical drum body having further an inlet at its one end portion and an outlet at its other end portion, said cast components being supplied through said inlet into said cylindrical drum body and being discharged through said outlet from said cylindrical drum body, wherein the center of gravity G of said vibratory drum machine is distant from the axis of said cylindrical drum body and the center P of said means for generating a vibratory force is distant from the peripheral wall of said cylindrical drum body, said peripheral wall defining an inner cylindrical wall surface, elliptical vibrations imparted to said inner wall surface being effected in such a manner that directions of the longer axis of the elliptical vibrations change gradually and continuously along said inner cylindrical wall surface and said cast components move upward along said inner cylindrical wall surface to a certain level and then circulate downward along a path spaced inward from said inner cylindrical wall surface.

15. A vibratory drum machine according to claim 14 wherein the means for generating an elliptical vibratory force each comprise a first unbalance weight, a second unbalance weight and gear mechanism for transmitting the rotational forces of said electric motor to said first and second unbalance weights at the same speed in the opposite directions, m×r (mass×distance between a rotational center and gravity center) of said first unbalance weight being smaller than that of said second unbalance weight.

16. A vibratory drum machine according to claim 14 wherein the means for generating a circular vibratory force each comprise an electric motor supported on the earth, bearing means supported on the peripheral wall of said cylindrical drum body, support axis means rotatably supported by said bearing means and connected through universal joint means to a drive shaft of said electric motor, and unbalance weight means fixed to said support axis means.

* * * * *